US009358991B2

(12) United States Patent
Hjort et al.

(10) Patent No.: US 9,358,991 B2
(45) Date of Patent: Jun. 7, 2016

(54) MULTI-CAR VEHICLE

(71) Applicant: DELLNER COUPLERS AB, Falun (SE)

(72) Inventors: Mathias Hjort, Hedemora (SE); Roger Danielsson, Krylbo (SE); Fredrik Hedh, Avesta (SE); Tommy Fälth, Hedemora (SE)

(73) Assignee: DELLNER COUPLERS AB, Falun (SE)

( * ) Notice: Subject to any disclaimer, the term of this patent is extended or adjusted under 35 U.S.C. 154(b) by 0 days.

(21) Appl. No.: 14/365,454

(22) PCT Filed: Dec. 13, 2012

(86) PCT No.: PCT/EP2012/005145
§ 371 (c)(1),
(2) Date: Jun. 13, 2014

(87) PCT Pub. No.: WO2013/087207
PCT Pub. Date: Jun. 20, 2013

(65) Prior Publication Data

US 2015/0007744 A1 Jan. 8, 2015

(30) Foreign Application Priority Data

| | | |
|---|---|---|
| Dec. 13, 2011 | (EP) | 11009818 |
| Jan. 20, 2012 | (EP) | 12000360 |
| May 29, 2012 | (EP) | 12004117 |
| Aug. 21, 2012 | (EP) | 12005978 |
| Aug. 21, 2012 | (EP) | 12005979 |
| Sep. 18, 2012 | (EP) | 12006533 |
| Sep. 18, 2012 | (EP) | 12006535 |

(51) Int. Cl.
*B61G 5/00* (2006.01)
*B61D 17/20* (2006.01)
(Continued)

(52) U.S. Cl.
CPC *B61G 5/00* (2013.01); *B61D 3/187* (2013.01); *B61D 17/20* (2013.01); *B61D 17/22* (2013.01); *B61F 1/12* (2013.01); *B61F 5/50* (2013.01); *B61G 7/10* (2013.01)

(58) Field of Classification Search
CPC ..... B61D 17/20; B61D 3/187; B61F 1/12; B61G 7/10; B61G 5/02; B61G 5/00
See application file for complete search history.

(56) References Cited

U.S. PATENT DOCUMENTS 1,501,325 A * 7/1924 Elliott ..... 105/4.1
1,648,893 A 11/1927 Comley
(Continued)

FOREIGN PATENT DOCUMENTS

DE 4238315 C1 4/1994
FR 2446732 A1 8/1980
(Continued)

OTHER PUBLICATIONS

International Search Report dated Apr. 11, 2013 for related PCT application No. PCT/EP2012/005145.

*Primary Examiner* — Jason C Smith
(74) *Attorney, Agent, or Firm* — Howard IP Law Group

(57) ABSTRACT

A multi-car vehicle with a first car of the multi-car vehicle and a second car of the vehicle and having a connection device having an elongated body for transmitting the pushing force required to push the first car in front of the second car, when the second car is moving, the elongated body having a longitudinal axis, a connection to connect the elongated body to the first car or the second car and suitable to transmit the pushing force from the second car to the elongated body or from the elongated body to the first car, the first car and/or the second car having an underframe that comprises at least one longitudinal beam and/or at least one cross beam, wherein the elongated body is arranged approximately at the same vertical level as the longitudinal beam and/or the cross beam and/or is arranged in such a manner that with regard to the vertical direction the elongated body at least partially overlaps with the beam.

10 Claims, 15 Drawing Sheets

Figure 1:
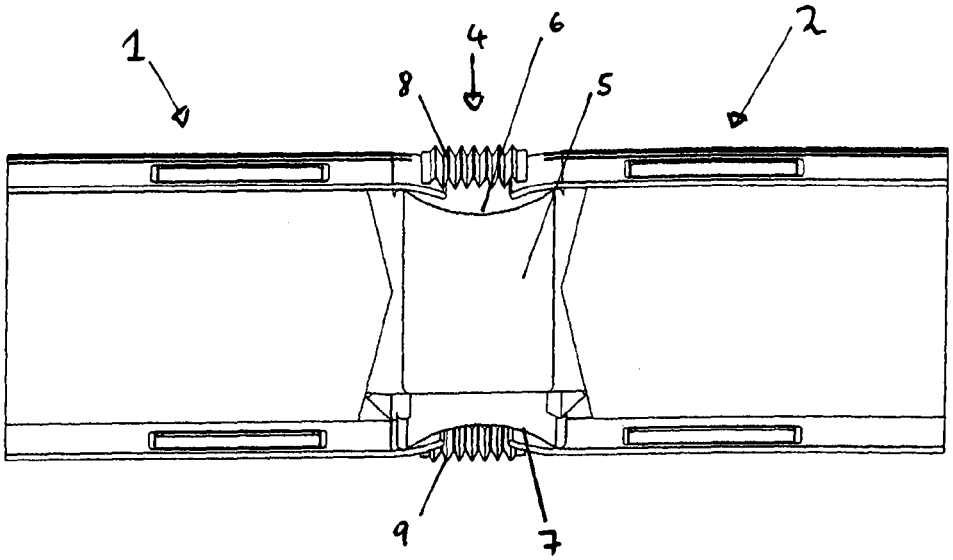

(51) Int. Cl.

| | |
|---|---|
| ***B61D 17/22*** | (2006.01) |
| ***B61D 3/18*** | (2006.01) |
| ***B61F 1/12*** | (2006.01) |
| ***B61F 5/50*** | (2006.01) |
| ***B61G 7/10*** | (2006.01) |

(56) References Cited

U.S. PATENT DOCUMENTS

| | | | | | |
|---|---|---|---|---|---|
| 1,740,357 | A | * | 12/1929 | Kjolseth | 105/175.1 |
| 2,113,542 | A | * | 4/1938 | Dean | 213/14 |
| 4,421,340 | A | * | 12/1983 | Kramer et al. | 280/479.1 |
| 5,377,597 | A | * | 1/1995 | Richter et al. | 105/4.1 |
| 5,687,860 | A | * | 11/1997 | Behrens et al. | 213/7 |
| 5,953,997 | A | * | 9/1999 | Andre et al. | 105/4.1 |
| 2008/0156762 | A1 | * | 7/2008 | Seitzberger et al. | 213/76 |
| 2014/0284297 | A1 | * | 9/2014 | Peckham et al. | 213/75 R |
| 2015/0000550 | A1 | * | 1/2015 | Hjort et al. | 105/15 |

FOREIGN PATENT DOCUMENTS

| | | | |
|---|---|---|---|
| FR | 2792595 | A1 | 10/2000 |
| FR | 2798889 | A1 | 3/2001 |
| WO | 2012067526 | | 5/2012 |

* cited by examiner

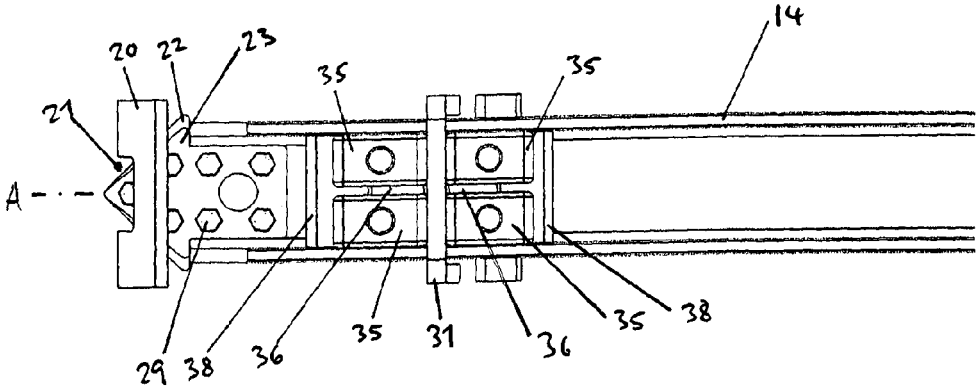
Fig. 7
Fig. 8
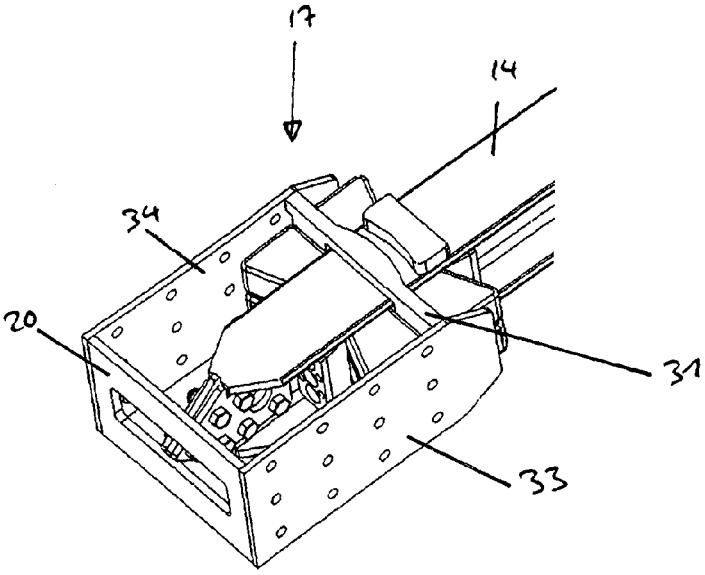

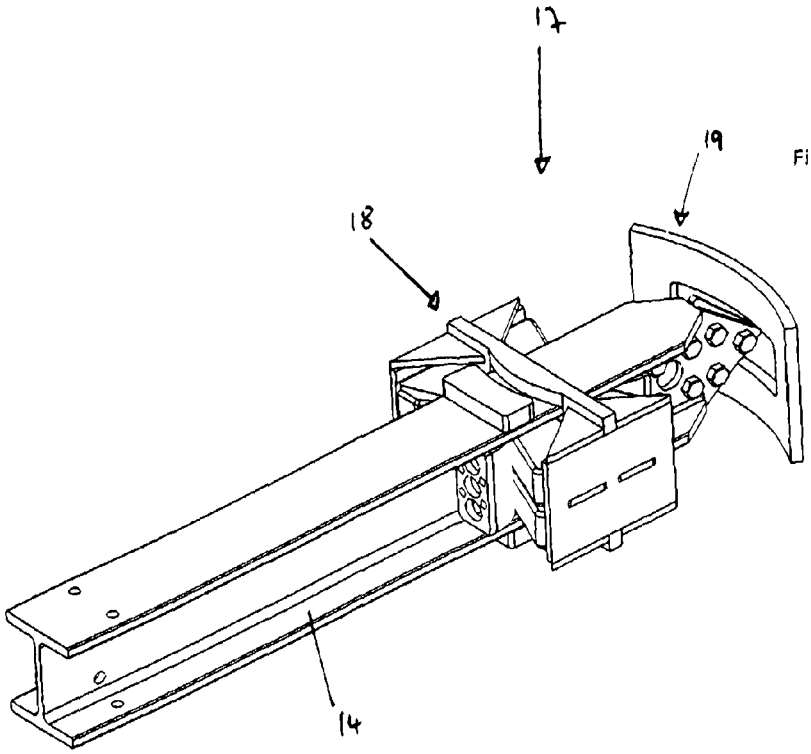
Fig. 11
Fig. 12
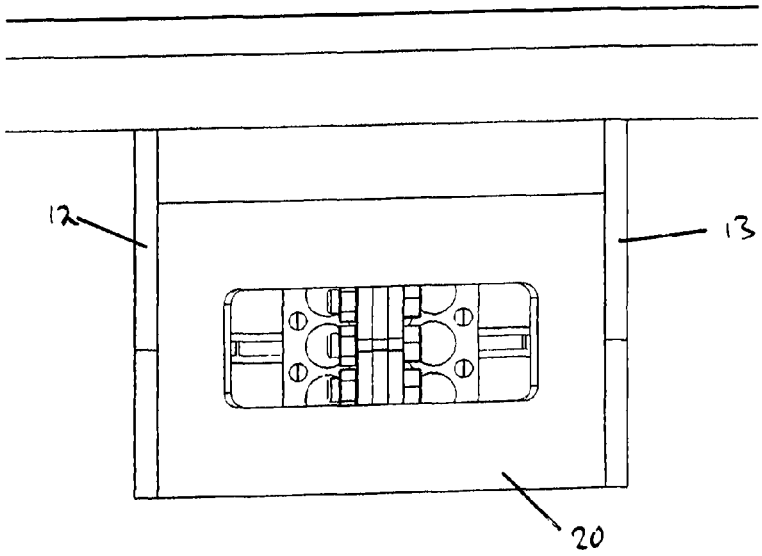

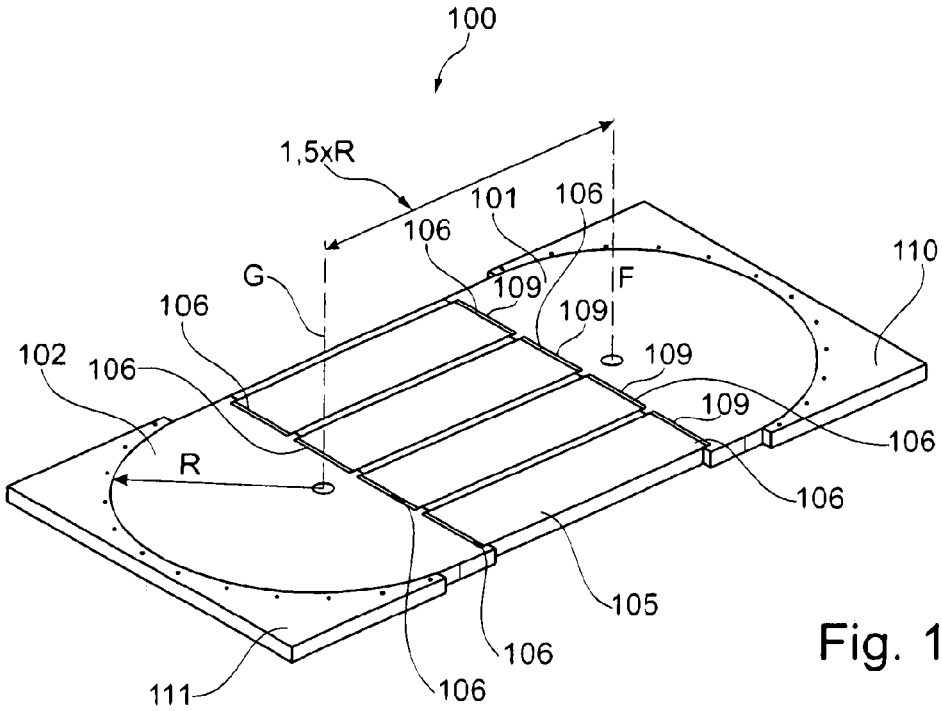
Fig. 15
Fig. 16
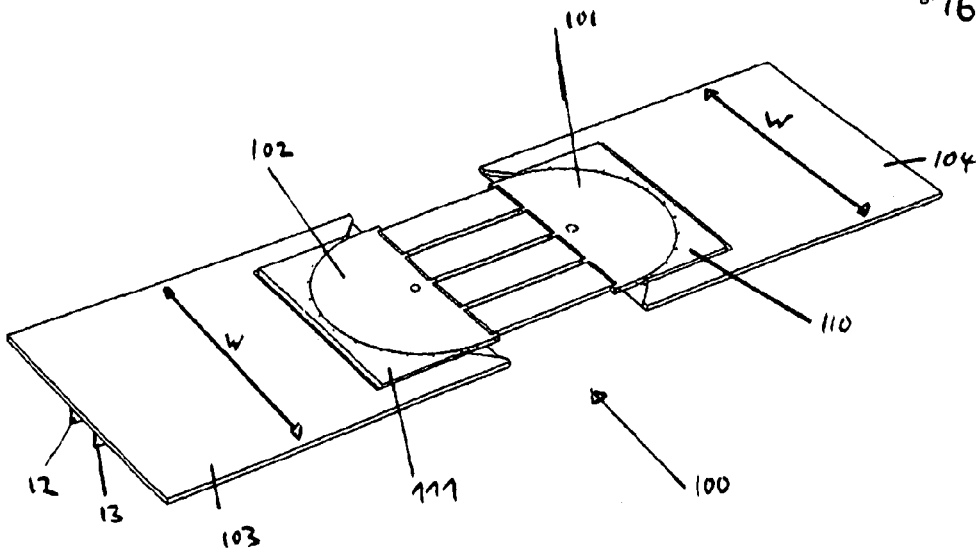

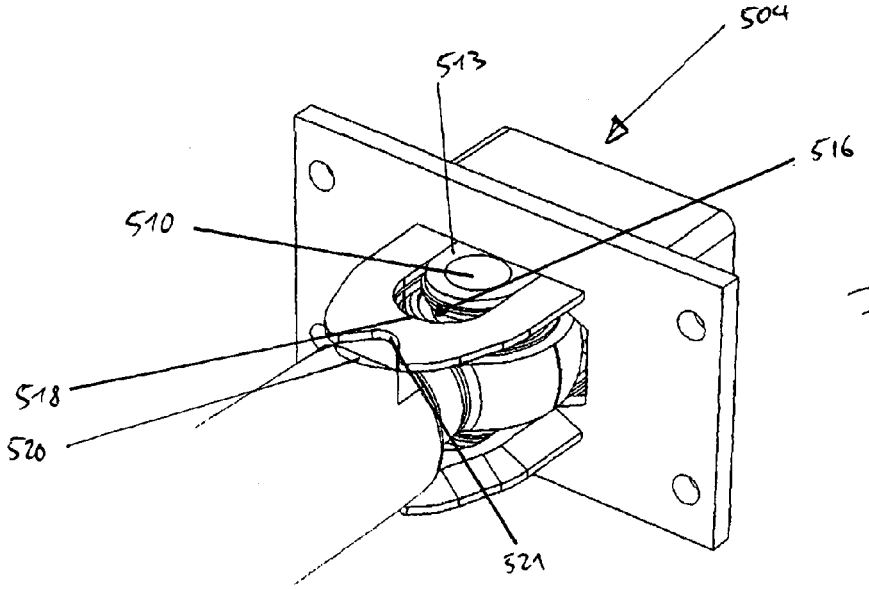
Fig. 28
Fig. 27
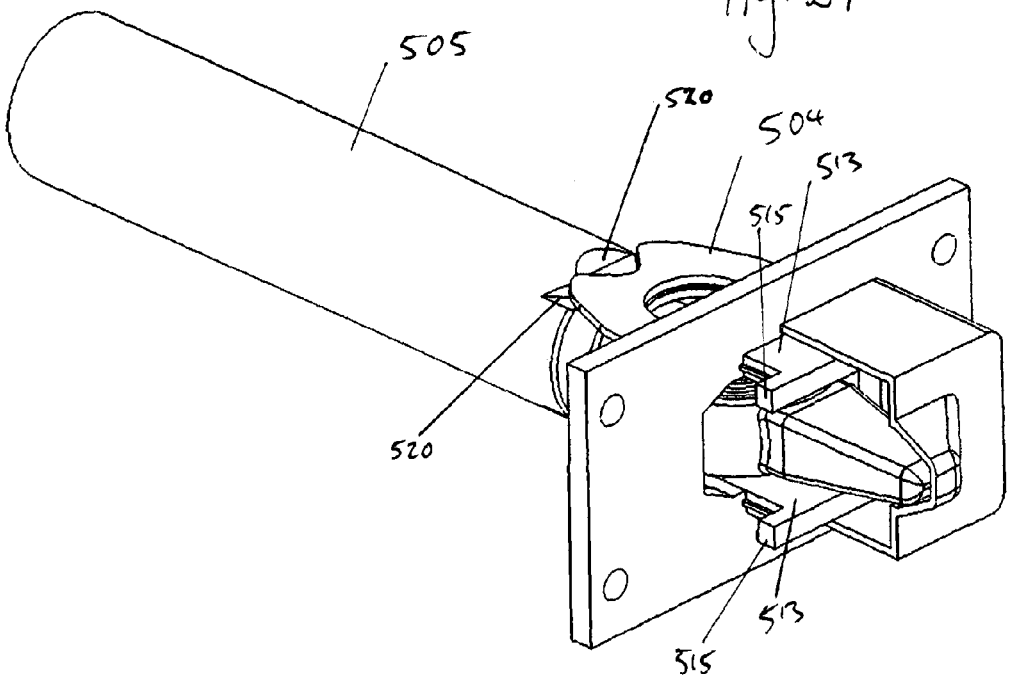

MULTI-CAR VEHICLE

CROSS-REFERENCE TO RELATED APPLICATIONS

This application is the national stage application under 35 U.S.C. §371 of International Application No. PCT/EP2012/005145 and claims the benefit of Int'l. Application No. PCT/EP2012/005145, filed Dec. 13, 2012, and European Application No. 11009818.3, filed Dec. 13, 2011, European Application No. 12000360.3, filed Jan. 20, 2012, European Application No. 12004117.3, filed May 29, 2012, European Application No. 12005979.5, filed Aug. 21, 2012, European Application no. 12005978.7, filed Aug. 21, 2012, European Application No. 12006535.4, filed Sep. 18, 2012, and European Application No. 12006533.9, filed Sep. 18, 2012, the entire disclosures of which are incorporated herein by reference in their entireties.

The invention pertains to a multi-car vehicle.

Multi-car vehicles are known in different designs and in different forms of adaptation for uses. Multi-car vehicles, for example, railway-bound trains (street cars and subway-trains also being considered as such trains) are known and are known for the purpose of transporting passengers as well as transporting goods. Further types of multi-car vehicles can be magnetic railway trains or can be busses (road buses as well as buses traveling on fixed tracks). A car of a multi-car vehicle can be a self-supporting cars, whereby the car has sufficient wheels that are placed at sufficient locations such that the car can stand by itself without being supported by other cars, for example a three-wheeled car, a four wheeled car or a car with even more wheels placed suitable locations. A car of a multi-car vehicle can also be of the non-self-supporting type, whereby the car has no wheels or only wheels provided in such number or arranged at such a place that the car can not stand by itself, but is vertically supported by at least one neighboring car.

To form the multi-car vehicles, the individual cars of the vehicle are connected to one another by means of a connecting device. The connecting devices can be provided for different types of purposes. In multi-car vehicles where only one or only several of the total of cars is driven, the connecting devices are provided so that a driven car can drive a non-driven car and thus ensure that the complete vehicle travels with the same speed. Connecting devices are also distinguished between those connecting devices that allow for an easy decoupling of the cars, whereby easy decoupling is understood to be accomplished within a couple of minutes, or for what is called "semi-permanent" coupling of the cars, for which decoupling of the cars takes efforts and usually involves the vehicle to have been transported to a specific work shop. Trains, for example, can have coupler-heads as part of their connecting devices. These coupler-heads can, for example, be so called "automatic couplers" that allow decoupling within minutes.

It is an object of the invention to provide solutions that do away with at least one of the problems of the prior art.

This problem is solved by the subject matter of the independent claims. Preferred embodiments are given in the subordinate claims and the description following hereafter.

The invention is based on the basic concept to provide a multi-car vehicle with a first car of the multi-car vehicle and a second car of said vehicle having a connection device having an elongated body suitable for transmitting the pushing force required to push the first car in front of the second car, when the second car is moving, the elongated body having a longitudinal axis, a connection suitable to connect the elongated body to the first car or the second car and suitable to transmit the pushing force from the second car to the elongated body or from the elongated body to the first car.

The first car and or the second car have an underframe that comprises at least one longitudinal beam and/or at least one cross beam, whereby the elongated body is arranged approximately at the same vertical level as the longitudinal beam and/or the cross beam and/or is arranged in such a manner that with regard to the vertical direction the elongated body at least partially overlaps with the beam.

The arrangement of the elongated body at the at the same vertical level as the longitudinal beam and/or the cross beams and/or its arrangement in such a manner that with regard to the vertical direction the elongated body at least partially overlaps with the beams provides the advantage that a horizontal force that is transmitted through the underframe and is intended to be transmitted from the one car to the next car via the connection can be introduced directly into the connection device without having to be re-directed onto a lower vertical plane, where in the prior art designs the connection is usually placed.

The elongated body, which will preferably be a bar, and the longitudinal beam or cross beam will each have a vertical extend. It is therefore to be understood as one way of implementing the invention that the elongated body and the longitudinal beam or cross beam are arranged at the same vertical level, if the horizontal line that runs through the centre of gravity of the elongated beam is in the same horizontal plane as the horizontal line that runs through the centre of gravity of the relevant longitudinal beam or the relevant cross beam. The invention can also be implemented in an embodiment by choosing the longitudinal beam or the cross beam to have an I-shape (capital letter I in the font "Courier") and to position the elongated body in such a manner that its centre of gravity will lie between the horizontal plane in which the upper flange of the I-shaped beam lies and the horizontal plane in which the bottom flange of the I-shaped beam lies. If the longitudinal beam or the cross beam is designed as a section of an extrusion profile and this extrusion profile is designed to have an upper flange and a lower flange similar to the shape of an I-shaped beam, the invention can also be implemented in an embodiment by choosing to position the elongated body in such a manner that its centre of gravity will lie between the horizontal plane in which the upper flange lies and the horizontal plane in which the bottom flange lies.

A partial overlap with regard to the vertical direction of the elongated body with a beam is given, if the cross section of the elongated body in a plane that has the longitudinal axis of the multi-car vehicle as normal vector—when viewed in the direction of this longitudinal axis—partially overlaps with the cross section of the beam in a plane that has the longitudinal axis of the multi-car vehicle as normal vector. If the shape of the elongated body changes along its extend along the longitudinal axis, the invention is implemented in a preferred embodiment in such a manner that the largest cross section of the elongated body in a plane that has the longitudinal axis of the multi-car vehicle as normal vector—when viewed in the direction of this longitudinal axis—partially overlaps with the smallest cross section of the beam in a plane that has the longitudinal axis of the multi-car vehicle as normal vector.

In a preferred embodiment, the elongated body will be a bar. The term "bar" not only being understood as solid bars, but also including hollow bars, for example.

In a preferred embodiment in the multi-car vehicle according to the invention the underframe has a central longitudinal beam that is arranged approximately along the longitudinal axis of the first car, whereby the elongated body is arranged approximately at the same vertical level as central longitudinal beam and/or is arranged in such a manner that with regard to the vertical direction the elongated body at least partially overlaps with the central longitudinal beam. Preferably, the elongated body overlaps with the central longitudinal beam at least with 50% of the cross section of the elongated body, even more preferred with 75% of the cross section of the elongated body, even more preferred with 90% of the cross section of the elongated body. In a preferred embodiment whereby the central beam is not designed to widen its cross section substantially in the vertical direction towards the end of the first car.

In a preferred embodiment in the multi-car vehicle according to the invention the underframe has a cross beam supported by a bogie, whereby the elongated body is arranged approximately at the same vertical level as cross beam supported by the bogie and/or is arranged in such a manner that with regard to the vertical direction the elongated body at least partially overlaps with the cross beam supported by the bogie. Preferably, the elongated body overlaps with the cross beam at least with 50% of the cross section of the elongated body, even more preferred with 75% of the cross section of the elongated body, even more preferred with 90% of the cross section of the elongated body.

In a preferred embodiment in the multi-car vehicle according to the invention the underframe has side-beams that run parallel to the longitudinal axis of the first car, but at the sides of the first car and whereby the side-beams end before the end of the first car and whereby a door of the first car is arranged in the section of the first car that has no side-beam. Preferably reinforcement structures are provided to connect a central longitudinal beam to the side-beams at the end of the side beams. This allows for a structure of the support beam, but at the same time allows for the door to be arranged at a location that allows easy entry or disembarcment for the multi-car vehicle.

In a preferred embodiment, the connection that connects the elongated body to the first car or the second car and that is suitable to transmit the pulling force and/or the pushing force from the second car to the elongated body or from the elongated body to the first car comprises a welded section or a section connected together by screws. This welded section or the section connected together by screws connects the elongated body to a beam of the underframe, preferably a central beam of the underframe of the multi-car vehicle.

In DIN 25603, Blatt 1 (version of September 1966), DIN 25603, Blatt 2 (version of October 1966), DIN 25603, Blatt 3 (version of December 1967), DIN 25603, Blatt 4 (Version of December 1967) and DIN 25603, Blatt 5 (Version of December 1967), DIN 25603 (Version of June 1969) underframes of different types of cars of different types of multi-car vehicles. The term "longitudinal beam" as used in the claims and the description of this invention is to be understood to at least encompass beams that are designed and/or arranged like any one of the "Langtraeger" mentioned in those DIN. Likewise the term "cross beam" as used in the claims and the description of this invention is to be understood to at least encompass beams that are designed and/or arranged like any one of the "Quertraeger" mentioned in those DIN. The terms "longitudinal beam" and "cross beam" are preferably, however, not to be understood to be limited to only refer to exactly that design and shape of the "Langtraeger" and "Quertraeger" as shown in those DIN. It is known to the person skilled in the art that the underframe of cars of multi-car vehicles is adapted in many way to suit the specific design of the car and/or to suit the specific statics of the car. For example, designs are known, where of the elements used to transmit horizontal forces through the car, only towards the respective end of the car, longitudinal beams are provided as underframe, while in the middle of the car, the surrounding structure (for example the walls and the floor) of the car are used to transmit the horizontal forces through the car. A longitudinal beam therefore does not need to run along the complete length of a car. Likewise, a cross beam does not need to run across the complete width of the car. The basic concept of the invention is to avoid having to re-direct horizontal forces into a lower vertical plane specifically only for them to be introduced into the connection. For this reason the basic concept of the invention is to place the connection and especially the elongated body of the connection device at or at least as close as possible to the a vertical level at which the elements of the construction of the car are placed that pass the horizontal forces along beams. It is also known to the skilled person that for specific types of multi-car vehicles, the car is—at least partially—made up of extruded profiles. These extruded profiles can have sections that are designed to transmit horizontal forces along the longitudinal direction of the car. For these embodiments, the invention can be implemented to understand the term "longitudinal beam" to refer to those sections of an extruded profile that is designed to transmit horizontal forces along the longitudinal direction of the car.

It is known that longitudinal beams of the underframe of a car change their vertical extend along the longitudinal axis. For example DIN 25 603 Blatt 3 shows the longitudinal beam (Langtraeger 15) to widen at two section, namely at the part where the holder for the step (Halter fuer Trittrost 11) is provided and at the section where the beam for the central buffer coupling (Traeger fuer Mittelpufferkupplung 18) is provided. In a preferred embodiment the term "at the same vertical level as the longitudinal beam and/or the term "is arranged in such a manner that with regard to the vertical direction the elongated body at least partially overlaps with the beams" is understood to refer those sections of the beams that have the minimal vertical extend necessary to fulfil their purpose of transmitting horizontal forces along the car.

As stated above, in a preferred embodiment the central beam is not designed to widen its cross section substantially in the vertical direction towards the end of the first car. As an example, with the invention the widening of the longitudinal beams (Langtraeger 15) in DIN 25 603 Blatt 3 at the right hand side of the car at the section, where the beam for the central buffer coupling (Traeger fuer Mittelpufferkupplung 18) is provided, can be avoided.

In a preferred embodiment, the invention can be implemented by further making use of the idea of allowing the elongated body typically provided in connection devices to rotate about a pivot axis in a first operational state, but to block the rotational movement after the elongated body has been moved along its longitudinal axis a predefined amount, for example by applying a predefined amount of force acting along the longitudinal axis of the elongated body. According to the invention this blocking of the rotational movement is achieved by means of elements provided in front and behind the pivot axis (when looking in the longitudinal axis of the elongated body).

In a preferred embodiment an assembly of parts suitable to be used as part of a connecting device for connecting a first car of a multi-car vehicle with a second car of said vehicle is provided, comprising:

a elongated body suitable for transmitting a pulling force required to pull the first car after the second car, when the second car is moving, and/or suitable for transmitting the pushing force required to push the first car in front of the second car, when the second car is moving, the elongated body having a longitudinal axis, a connection suitable to connect the elongated body to the first car or the second car and suitable to transmit the pulling force and/or the pushing force from the second car to the elongated body or from the elongated body to the first car, the connection defining a pivot axis about which the elongated body can pivot relative to other parts of the connection, the pivot axis crossing the elongated body and/or the longitudinal axis, the connection having connecting parts suitable to be connected to the first car, whereby the elongated body is elastically connected to the connecting parts thereby allowing the elongated body to move relative to the connecting parts in the direction of the longitudinal axis whereby a first blocking surface or a first locking member being arranged on the elongated body on one side of the pivot axis, the first blocking surface or first locking means being held distanced from a corresponding blocking surface or a corresponding locking means respectively arranged on the connecting parts in a first operational state and the first blocking surface or the first locking means being in contacted with the corresponding blocking surface or the locking means in a second operational state, when the elongated body has been moved along its longitudinal axis relative to the connecting parts, the contact between the respective blocking surfaces or the contact between the respective locking means blocking a rotation of the elongated body about the pivot axis and a second blocking surface or a second locking member being arranged on the elongated body on the opposite side of the pivot axis relative to the first blocking surface or the first locking means, the second blocking surface or second locking means being held distanced from a corresponding blocking surface or a corresponding locking means respectively arranged on the connecting parts in a first operational state and the second blocking surface or the second locking means being in contacted with the corresponding blocking surface or the locking means in a second operational state, when the elongated body has been moved along its longitudinal axis relative to the connecting parts, the contact between the respective blocking surfaces or the contact between the respective locking means blocking a rotation of the elongated body about the pivot axis.

In a preferred embodiment an assembly of parts suitable to be used as part of a connecting device for connecting a first car of a multi-car vehicle with a second car of said vehicle is provided, comprising:

a elongated body suitable for transmitting a pulling force required to pull the first car after the second car, when the second car is moving, and/or suitable for transmitting the pushing force required to push the first car in front of the second car, when the second car is moving, the elongated body having a longitudinal axis, a connection suitable to connect the elongated body to the first car or the second car and suitable to transmit the pulling force and/or the pushing force from the second car to the elongated body or from the elongated body to the first car, the connection defining a pivot axis about which the elongated body can pivot relative to other parts of the connection, the pivot axis crossing the elongated body and/or the longitudinal axis, the connection having connecting parts suitable to be connected to the first car, whereby the elongated body is elastically connected to the connecting parts thereby allowing the elongated body to move relative to the connecting parts in the direction of the longitudinal axis whereby a first blocking surface or a first locking member being arranged on the elongated body on one side of the pivot axis, the first blocking surface or first locking means being held distanced from a corresponding blocking surface or a corresponding locking means respectively arranged on the connecting parts in a first operational state and the first blocking surface or the first locking means being in contacted with the corresponding blocking surface or the locking means in a second operational state, when the elongated body has been moved along its longitudinal axis relative to the connecting parts, the contact between the respective blocking surfaces or the contact between the respective locking means blocking a rotation of the elongated body about the pivot axis and a second blocking surface or a second locking member being arranged on the elongated body on the same side relative to the pivot axis that the first blocking surface or the first locking means are arranged on with regard to their arrangement along the longitudinal axis, the second blocking surface or second locking means being held distanced from a corresponding blocking surface or a corresponding locking means respectively arranged on the connecting parts in a first operational state and the second blocking surface or the second locking means being in contacted with the corresponding blocking surface or the locking means in a second operational state, when the elongated body has been moved along its longitudinal axis relative to the connecting parts, the contact between the respective blocking surfaces or the contact between the respective locking means blocking a rotation of the elongated body about the pivot axis.

In a preferred embodiment the second blocking surface or the second locking member is arranged on the same side of the horizontal plane that contains the longitudinal axis as the first blocking surface or the second locking member respectively is arranged.

In a preferred embodiment, the interaction between an inclined surface provided on one part and a counter-surface arranged to come into contact with the inclined surface to prevent the elongated body to move further in the vertical direction than the interaction between the inclined surface and the counter-surface allows is used. Using an inclined surface allows for movements of the bar along its longitudinal axis, but at the same time allows for a limitation of the amount of movement along the longitudinal axis. As the bar moves along its longitudinal axis, a gap that is be provided between the inclined surface and the counter-surface in a first operating condition, in which the bar is in a first position, can be closed due to the movement of the bar along its longitudinal axis. Making use of the inclined surface allows for manufacturing tolerances to be considered for and still to allow for a safe contact between the inclined surface and the counter-surface. Depending on the operating conditions it is possible that the bar is not always kept in a predetermined position of its longitudinal axis. Operating conditions can exist, where the bar is displaced in a direction perpendicular to its longitudinal axis. But even in such conditions, the inclined surface allows for a contact between the inclined surface and the counter-surface once the bar has moved in the direction of its longitudinal axis. The contact between the inclined surface and the counter-surface might not take place always at the same point along the inclined surface. But a contact between the counter-surface and the inclined surface will take place and therefore will ensure that the bar is prevented to move further in the vertical direction than the interaction between the inclined surface and the counter-surface allows.

A blocking surface can, however, also be provided by providing a flat surface on the elongated body that faces a flat surface on a separate part of the connection device, both flat surfaces preferably being arranged to be perpendicular to the longitudinal axis of the bar. If these blocking surfaces are pressed against each other by a force acting along the longitudinal axis of the bar, the surfaces will prevent a pivoting.

Locking means can for example be provided by hooks that cooperate with corresponding recesses or wedges that are forced into recesses.

For connecting devices for trains, an elongated body in form of a bar (often called the drawbar) is provided. In the terminology of connecting devices for trains, such a bar can be a solid body but could also be a hollow body. To simplify the description of the invention, the term "bar" will be used in the following. The term "bar" does not refer to a solid bar, only, however, but is to be understood to refer to any kind of elongated body, especially also to hollow bars or bars that for a certain part of their longitudinal extend are hollow, but for other parts of their longitudinal extend are solid.

The invention can be put in place by providing the inclined surface at a front section of the bar. However, the invention can also be put into practise by providing the bar with a counter-surface and to provide a different element with the inclined surface. Bend surfaces are also understood to be inclined surfaces.

The counter surface can be a horizontal surface. Also, the edge of a horizontal surface bordering a vertical surface is considered as a counter-surface in the sense of the invention. The counter-surface could also be provided by an inclined surface.

In a preferred embodiment, the bar has a first inclined surface provided at the front end section of the bar and has a second inclined surface arranged symmetrically to the first inclined surface about the longitudinal axis of the bar. Preferably, a first counter-surface that is arranged to come into contact with the first inclined surface to prevent the bar to move further in the vertical direction than the interaction between the first inclined surface and the first counter-surface is provided as well as a second counter-surface that is arranged to come into contact with the second inclined surface to prevent the bar to move further in the vertical direction than the interaction between the second inclined surface and the second counter surface allows. Such an arrangement allows the upward and downward movement of the bar to be limited.

The basic idea of the invention can also advantageously be implemented by choosing a bar that has at least for a section along its longitudinal axis a cross section in a plane perpendicular to the longitudinal axis of the bar that is not ring-shaped and/or not circular. In a preferred embodiment, the bar is I-shaped or T-shaped or X-shaped or cross-shaped or +-shaped or has a rectangular, non-quadratic cross section in the plane perpendicular to the longitudinal axis of the bar or has a cross section with the form of an ellipse in the plane perpendicular to the longitudinal axis of the bar. I-shaped (or I-shaped) being understood as the form of the capital letter I when printed in the font "Courier". The term ring-shaped is understood to mean the object that is represented by the area between an outer circle and an inner circle with the same center. The term "circular" is to be understood as the area inside of a circle. According to this basic concept of the invention, such ring-shaped or circular cross sections are avoided, since they do not allow to specifically design the bar for the different type of forces acting on the bar in the different directions perpendicular to its longitudinal axis easily. However, this basic concept of the invention does not for example exclude cross sections of the shape of an elliptical ring (the area between an outer ellipse and an inner ellipse set into the inner ellipse) or of a rectangular ring (the area between a larger, non quadratic rectangle and a smaller, non quadratic rectangle set inside the larger rectangle). The bar can also be made up of individual sub-bars, for example sub-bars with round or quadratic cross section that are arranged such that five such sub-bars are placed such that their cross-sections perpendicular to their longitudinal extend are arranged similar to the arrangement of the dots on a dice for the five on a dice. Similarly the bar can also be made up of individual sub-bars, for example sub-bars with round or quadratic cross section that are arranged such that four such sub-bars are placed such that their cross-sections perpendicular to their longitudinal extend are arranged similar to the arrangement of the dots on a dice for the four on a dice. A bar made up of such sub-sections is in total also not ring-shaped and/or not circular. In a preferred embodiment, the bar has a cross-section perpendicular to its longitudinal axis that has the shape of a hollow cross or a hollow +-shape.

Using such a specific bar allows the bar to be especially adapted to the fact that the magnitude of the different forces acting in different directions on the bar to differ. The largest forces to be expected to act on the bar in normal operation, which is understood for the vehicle to be travelling at its normal speeds, will be the pulling force or the pushing force from the second car to the first car. These forces will typically act along the longitudinal axis of the bar. To give an example of the magnitude of these forces: in trains these pulling or pushing forces can in certain driving conditions be about 1300 kN, for Metro trains or street cars these forces can in certain driving conditions be 500 to 600 kN or can even be as low as 40 kN. The bar is preferably designed to transmit such forces, if the connection is to be used in this context without being deformed permanently. In addition to this pulling or pushing force, a horizontal force and a vertical force will act on the bar in certain driving conditions of the multi-car vehicle, into which the bar is built. The vertical forces can be substantial in cases where the bar needs to prevent the climbing of the one car onto the second car (so called "anti-climbing" function). Substantial horizontal forces can act on the bar in crash situations, where one car pivots around a vertical axis into the direction of a parallel alignment with the other car (so called "jack knifing"-condition). However, the level of forces to prevent the climbing and the level of forces to prevent the jack knifing can be different.

In a preferred embodiment, the section along the longitudinal axis of the bar that is I-shaped or T-shaped or X-shaped or +-shaped or has a rectangular, non-quadratic cross section in the plane perpendicular to the longitudinal axis of the bar or has a cross section with the form of an ellipse in the plane perpendicular to the longitudinal axis of the bar makes up at least 50% of the length of the bar, especially preferred 60%, even more preferred 70% and even more preferred 80% of the length of the bar in the direction of the longitudinal axis. In a preferred embodiment, the section with the prescribed characteristics is an uninterrupted section, a continuous section. It is, however, also possible that in other embodiments of the invention, the section takes up 50% of the length of the bar in its longitudinal axis, but is interrupted within itself by parts that have a different shape, for example by dampers or by energy-dissipating elements arranged at a certain place along the longitudinal extend of such a section. The length is preferably understood to be the length from the free end of the bar provided at the connection to the point where the bar is joined to a connection at the other car or depending on the design of the connection device to the point where the bar is connected to a coupler head or the like. As free end at the connection also an end of the bar is understood that interacts with a energy dissipating element, for example a deformation tube, arranged at the end of the bar at the connection.

In an alternative embodiment, only a small section of the bar is provided with the properties as described above, especially only the section at the free end of the bar. In a preferred embodiment, only 20% of the length of the bar, especially only 10% of the length of the bar, especially only 5% of the length of the bar are provided with the properties as described above, while in an even more preferred embodiment, the rest of the bar is provided with a round or ring shaped cross-section.

In a preferred embodiment, the section along its longitudinal extend has a cross section that is substantially the same for all cross sections taken in successive planes along the longitudinal axis of the bar that are perpendicular to the longitudinal axis of the bar. Keeping the bar to be substantially of the same cross section within the described section simplifies the manufacturing of such a bar.

In a preferred embodiment, the connection that is suitable to connect the bar to the first car or the second car and suitable to transmit the pulling force and/or the pushing force from the second car to the bar or from the bar to the first car comprises a plate that has a hole, through which the bar passes, the hole being big enough so that the bar can pass through the hole without touching the sidewalls delimiting the hole. Such a plate can allow for the bar to be held in a position during certain operational conditions, where the bar does not contact the plate, for example when it is held in a predetermined, non contacting position by damping elements. Depending on how the bar is further held, such a plate can, however, be used to transmit forces to the bar, once the bar has been displaced into a operating condition, where the bar partially contacts the plate, for example in extreme operating conditions, where extreme forces act. Such an embodiment reduces the friction between the bar and the plate and thus the wear during normal operating conditions, but at the same time allows for a good contact between the plate and the bar in extreme operating conditions and thus for a good transmittal of forces in extreme operating conditions, for example in a crash situation.

In a preferred embodiment, the hole is adopted to the cross section of the bar and preferably in shape similar to the cross section of that section of the bar that is inserted into the hole. In a preferred embodiment, the hole has a cross section that is not ring-shaped and/or not circular, preferably I-shaped or T-shaped or X-shaped or cross-shaped or +-shaped or has a rectangular, non-quadratic cross section in the plane perpendicular to the longitudinal axis of the bar or has a cross section with the form of an ellipse in the plane perpendicular to the longitudinal axis of the bar. Making the shape of the hole similar to the shape of the section of the bar that is inserted into the hole allows for a small clearance to be provided that prevents the contact between the bar and the plate in normal operating conditions, but at the same time allows for the contact between the bar and the plate to be established quickly, regardless in which direction the bar is moving. If—in a preferred embodiment—the clearance between the sidewalls delimiting the hole and the bar is substantially the same in all directions in normal operational mode, the contact between the bar and the plate will be established with the same amount of displacement of the bar, regardless in which direction the bar is displaced.

The use of a hole that is adopted to the cross section of the bar and preferably in shape similar to the cross section of that section of the bar that is inserted into the hole, provides the advantage that the hole can act as rotational limitation part that limits rotational movements of a section of the bar.

In a preferred embodiment, the bar has a guiding element with a guiding surface and the plate that has a hole has a guiding surface and whereby the guiding surface of the bar and the guiding surface of the plate are designed in such a manner that the cooperate upon contact in such a manner to allow certain movements, preferably a swiveling movement of the bar relative to the plate, but to not allow certain other movements, preferably vertical or lateral movements of the bar relative to the plate. Such a guiding element can act as an axial limitation part.

In a preferred embodiment the interaction of the counter-surface and the inclined surface can act as axial limitation part, whereby a further axial limitation part is provided by a protrusion on the bar that interacts with the plate that has a hole in. Both axial limitation parts in a preferred embodiment of the invention are placed on the same side of a horizontal plane that contains the longitudinal axis of the bar.

In a preferred embodiment an axial limitation part is provided that limits the axial movement of the bar relative to the plate that has a hole in at least in the forward or at least in the rearward axial direction, preferable in both the forward and the rearward axial direction of the bar, whereby the axial limitation part is provided by a protruding element that protrudes from the bar. In a preferred embodiment, the protruding element is arranged at a position along the longitudinal axis of the bar that is distant from the plate that has a hole in, but which is yet again arranged close enough to the plate that has a hole in to come into contact with the plate that has a hole in driving conditions, where the bar has been displaced in a direction along its longitudinal axis, for example in a crash situation. In a preferred embodiment, the protruding means are wedge shaped with the slim end pointing towards the plate that has a hole in and the thick end pointing away from the plate that has a hole in. Preferably, the slim end of the wedge is of a size that allows the wedge to partially enter into the space between the bar and the wall that delimits the hole in the plate. This provides the advantage of wedging the bar into the hole in the plate. This wedging action can be used to bring a turning momentum onto the bar, for example a turning momentum that turns a bar that has left a predetermined orientation of its longitudinal axis back into the direction of this predetermined orientation of its longitudinal axis. Such an action can, for example, assist actions to prevent anti-climb or anti-jack knifing. If the wedge is made to have a slim end that has a certain width and wherein the width wise direction is pointing perpendicular to the longitudinal axis, and where the plate is chosen to have a plane surface with the hole arranged in this plane surface and thus the delimiting walls of the hole having a straight line edge, the interaction between the slim part of the wedge and the straight line edge can also be used to place a rotational momentum onto the bar to bring the bar into a predetermined position of its longitudinal axis. If the wedge enters into the gap between the bar and the walls delimiting the hole at an angle, such that a certain part of the tip enters into the gap first the resistance at this point of entry for further movement of the bar in the axial direction will be higher than at other parts of the tip of the wedge that have not yet entered into the gap. This increased resistance will lead to the bar being turned into such a position that the wedge will tend to enter into the gap further in alignment with the line that runs from the tip of the wedge to the thick part of the wedge.

The axial limitation parts in the embodiment that is designed for parts of the axial limitation part to enter into the gap between the bar and the walls that delimit the hole, several wedges can be provided parallel to one another. Such a preferred embodiment can for example be used instead of a thick wedge that has a substantial width. By providing for example two slim wedges that are aligned in parallel, the same effect of placing a rotational moment onto the bar can be achieved, namely when the first wedge enters into the gap between the bar and the walls limiting the hole prior to the second wedge entering into this gap.

The axial limitation parts designed in the form of a wedge as described as a preferred embodiment can be provided in an especially preferred embodiment on just one side of the bar, for example can be provided on just one surface of a I or T-shaped bar or can for example be only provided on surfaces above a horizontal plane that contains the longitudinal axis of the bar. In a different, equally preferred embodiment, axial limitation parts formed in the preferred embodiment of a wedge can be provided above and below a horizontal plane that contains the longitudinal axis of the bar.

According to a preferred embodiment, the connection comprises a plate that has a hole, through which the bar passes, the hole being big enough so that the bar can pass through the hole without touching the sidewalls delimiting the hole and the connection comprises

- a vertical limitation part that limits the vertical movement of a section of a horizontally extending bar, whereby the vertical limitation part limits the vertical movement of the section of the bar that passes through the hole, when the bar is extending horizontally, and/or the vertical movement of a section of the bar in the proximity of the hole, whereby the vertical limitation part is designed to limit the vertical movement only at a place proximate the plate, while it allows vertical movements further away from the plate to allow the bar to swivel about a horizontal axis at or in proximity of the plate with the hole in and/or
- a lateral limitation part that limits the sideways movement of a section the bar when the bar is extending horizontally, whereby the lateral limitation part limits the sideways movement of the section of the bar that passes through the hole, when the bar is extending horizontally, and/or the sideways movement of a section of the bar in the proximity of the hole, whereby the lateral limitation part is designed to limit the lateral movement only at a place proximate the plate, while it allows lateral movements further away from the plate to allow the bar to swivel about a vertical axis at or in proximity of the plate with the hole in and/or
- a rotational limitation part that limits rotational movements of a section of the bar and/or
- an axial limitation part that limits the axial movement of the bar relative to the plate that has a hole in at least in the forward or the rearward axial direction of the bar.

Preferably an axial limitation part and a vertical limitation part are provided and whereby the horizontal axis about which the bar is allowed to swivel changes its position relative to the plate that has a hole in depending on the axial position of the bar and/or an axial limitation part and a lateral limitation part are provided, whereby the vertical axis about which the bar is allowed to swivel changes its position relative to the plate that has a hole in depending on the axial position of the bar. In a preferred embodiment the axial limitation part is provided by rubber elements provided in front and behind the plate. In a first axial position of the bar, the rubber elements will be in a first state and by their coefficient of elasticity define a first position of the horizontal axis or the vertical axis. In a second axial position, in which the bar has moved by compressing the rubber elements on the one side of the plate and relaxing the rubber elements on the other side of the plate, due to the rubber elements on the one side having been compressed and thus having stiffened, the position of the horizontal axis or the vertical axis is changed, namely moved towards the rubber elements hat have been relaxed.

In a preferred embodiment, the first inclined surface and the second inclined surface form part of a wedge or a cone. As wedge or a cone are features that can easily manufactured on the end of a bar.

The inclined surface provided on the bar or—in the alternative embodiment—the counter-surface provided on the bar needs not to be provided by manufacturing a specific surface onto the bar. The inclined surface or the counter-surface respectively can also be provided by elements that are connected to the bar. In a preferred embodiment, the inclined surface is provided by a wedge, which is provided by a triangular plate that is attached to the bar. In an even more preferred embodiment, a second and a third wedge are provided by a second and a third triangular plate attached to the bar or attached to the first triangular plate, preferably having different angles of inclination than the first triangular plate. Providing such a design of differently inclined surfaces allows for a good interaction between the inclined surface and the counter-surface.

In a preferred embodiment a plate with a cut-out, preferably a gap, preferably a longitudinal gap is provided. The cut-out in the plate can be a recess for example a bowl shaped recess. But it is preferred that the cut-out is a gap, which is understood to be a hole. This gap can be of circular or elliptical shape, but is preferably of rectangular, preferably non-quadratic shape. In this preferred embodiment, one of the surfaces limiting the cut-out forms the counter-surface. In designs, where more than one counter-surface is provided, it is preferred that the counter-surfaces are provided by surfaces that limit the cut-out. Arranging the counter-surface as the surface that limits a cut-out on a plate provides for an easy manner to provide the counter surface as part of an assembly of parts suitable to be used as part of a connecting device for connecting a first car of a multiple-car vehicle with a second car of said vehicle. The plate can, for example, be attached to a car of the multi-car vehicle, if the assembly of parts is used to form the connecting device and is thus connected to a car of a multi-car vehicle.

In a preferred embodiment, the inclined surface is provided by a wedge or a cone on the bar and the counter-surface is provided by surfaces that limit a cut-out on a plate. Such an arrangement can be used to dissipate energy in extreme operating conditions. Moving the bar along its longitudinal axis will bring the inclined surface into contact with the counter-surface. If the bar is forced to continue its travel along its longitudinal axis due to the operating conditions, the counter-surface will limit the vertical movement of the bar and therefore provide safe guidance of the travel of the bar. At the same time, the wedge or cone provided on the front end section of the bar will widen the cut-out in the plate. This widening action will dissipate energy and will therefore aid to control the energy dissipation in the extreme operating condition.

In a preferred embodiment the connection comprises a plate that has a hole, through which the bar passes, the hole being big enough, so that the bar can pass through the hole without touching the sidewalls delimiting the hole and whereby the counter-surface is arranged at a horizontal distance that is larger than one times the maximum distance across the bar in the plane perpendicular to the longitudinal axis. The plate that has a hole, through which the bar passes, can be used for positioning the bar in the vertical direction. At the same time, the plate that has a hole can act as a pivot-point and allows the bar to swivel about a horizontal axis that runs through the plate that has a hole or is proximate to that plate. As discussed above, the interaction between the inclined surface and the counter-surface can be used to limit the vertical movement of the front end section of the bar. In the arrangement, where the inclined surface and the counter-surface as well as the plate that has a hole are provided, the interaction between the inclined surface and the counter-surface can be used to limit the amount of swiveling that the bar can do about the horizontal axis running through the plate that has a hole or is proximate to that plate. Keeping the counter surface a substantial distance away from the plate that has a hole can advantageously be used to limit the swivel angle of the bar to a small amount. In a preferred embodiment, the counter surface is arranged at a horizontal distance that is larger than 1.5 times, preferably larger than 1.75 times and even more preferred larger than 2 times than the maximum distance across the bar in the plane perpendicular to the longitudinal axis. The maximum distance across the bar in the plane perpendicular to the longitudinal axis is understood especially to be that distance across the cross section of that section of the bar that passes through the hole.

In a preferred embodiment a plate with a cut-out, preferably a gap, preferably a longitudinal gap is provided. One of the surfaces limiting the cut-out forms the counter-surface. The plate that has a hole and the plate with the cut-out are connected by two side-plates that run parallel to each other so that the four plates together form a box. This provides for an easy to handle end portion of the connecting device that can easily be attached to the respective car. The embodiment can also be implemented by using a recess instead of a cut-out, for example a bowl-shaped recess.

In a preferred embodiment the plate with a cut-out is arch-shaped, preferably whereby the arch has a radius that equals the distance along the longitudinal axis of the bar from the hole in the plate with a hole to the plate with a cut-out. This allows for the counter-surface to be better positioned relative to the inclined surface, if the bar swivels about a vertical axis that runs through the plate with a hole.

In a preferred embodiment the assembly of parts has an energy absorbing section that is provided as part of the bar or arranged on the bar. The energy absorbing section is understood to be a section that is by its shape or its choice of material coefficient different to the bar and can take up energy by means of deformation better than other sections of the bar. In a preferred embodiment, the energy absorbing section is provided as energy dissipating section. The dissipation of energy is understood as the permanent uptake of energy or conversion of one energy form (for example the kinetic energy of a moving section of the bar) into a different type of energy, for example heat.

In a preferred embodiment the bar has a section that is formed by a hydraulic cylinder, the fluid of the hydraulic cylinder dissipating energy as the hydraulic cylinder is compressed, when axial forces are applied to the bar. Such a design can form an embodiment of the energy dissipating section as provided in a preferred embodiment. Additionally or as an alternative the bar can have a section that is designed as a deformation element, for example of a honey-cone design or of the design of a cone inserted in a deformation tube-section that deforms the deformation tube radially outward, when axial forces are applied to the bar or which cone is deformed radially inward by being pushed into a ring, when axial forces are applied to the bar.

The basic idea of the invention as described can be put into practice by providing the multi-car vehicle with a gangway floor for a gangway between a first car of the multi-car vehicle and a second car of said vehicle whereby the gangway floor comprising a first floor panel and a second floor panel, whereby the first floor panel is arranged to rotate about a first axis that does not lie in the plane that the first floor panel lies in and the second floor panel is arranged to rotate about a second axis that does not lie in the plane that the second floor panel lies in, whereby the first axis is different to the second axis and the first axis coincides with the pivot axis.

Additionally or alternatively the basic idea of the invention as described can be put into practice by arranging the assembly of parts in a multi-car, the multi-car vehicle having a gangway floor for a gangway between a first car of the multi-car vehicle and a second car of said vehicle whereby the gangway floor comprises a first floor panel that has the shape of a sector of a circle or the shape of a segment of a circle or the shape of a sector of a ring and a second floor panel that has the shape of a sector of a circle or the shape of a segment of a circle or the sector of a ring.

According to a further aspect of the invention, the invention makes use of the idea that a connection between the first car and the second car of a multi-car vehicle, if it can be designed with reduced height can be arranged in such a manner, that it is substantially in the same horizontal plane as the frames of the supporting frame that support the floor of the first car. This allows for forces that are transmitted along the multi-car vehicle to be transmitted in a straight line and for doing away with having to divert this horizontal forces into a lower plane, in which the connection might be arranged.

In a preferred embodiment, the connecting device comprises a first coupler head and a second coupler head that can be coupled to one another, but also allow the first car of the multi-car vehicle to be separated from the second car of the multi-car vehicle.

The multi-car vehicle according to the invention has a connecting device as described above. In a preferred embodiment the connecting device is arranged such that the bar is arranged substantially horizontal. In a preferred embodiment, the multi-car vehicle is a rail-bound train and in a preferred embodiment a rail-bound train suitable to travel faster than 100 km/h.

The invention is preferably used in railway-bound trains (street cars and subway-trains also being considered as such trains), be it for the purpose of transporting passengers or for the purpose of transporting goods. Further uses of the multi-car vehicles can for example be magnetic railway trains or can be busses (road buses as well as buses travelling on fixed tracks). A car of a multi-car vehicle can be a self-supporting car, whereby the car has sufficient wheels that are placed at sufficient locations such that the car can stand by itself without being supported by other cars, for example a three-wheeled car, a four wheeled car or a car with even more wheels placed at suitable locations. A car of a multi-car vehicle can also be of the none-self-supporting type, whereby the car has no wheels or only wheels provided in such number or arranged at such a place that the car can not stand by itself, but is vertically supported by at least one neighboring car.

Figure 2:
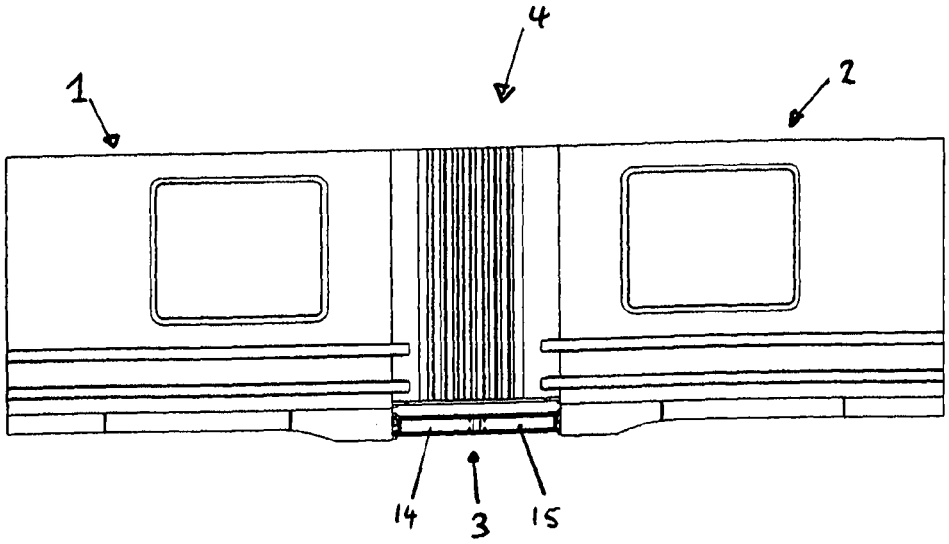
Figure 3:
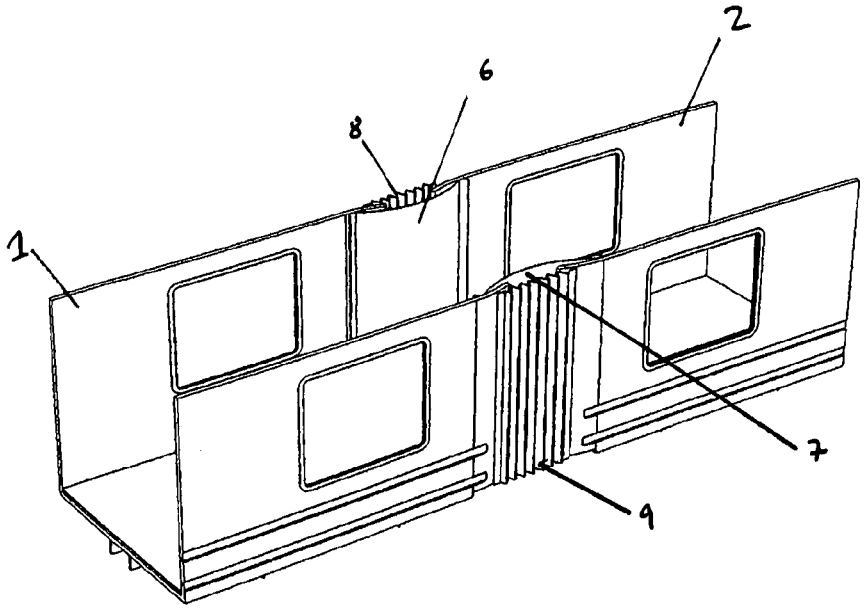
Figure 4:
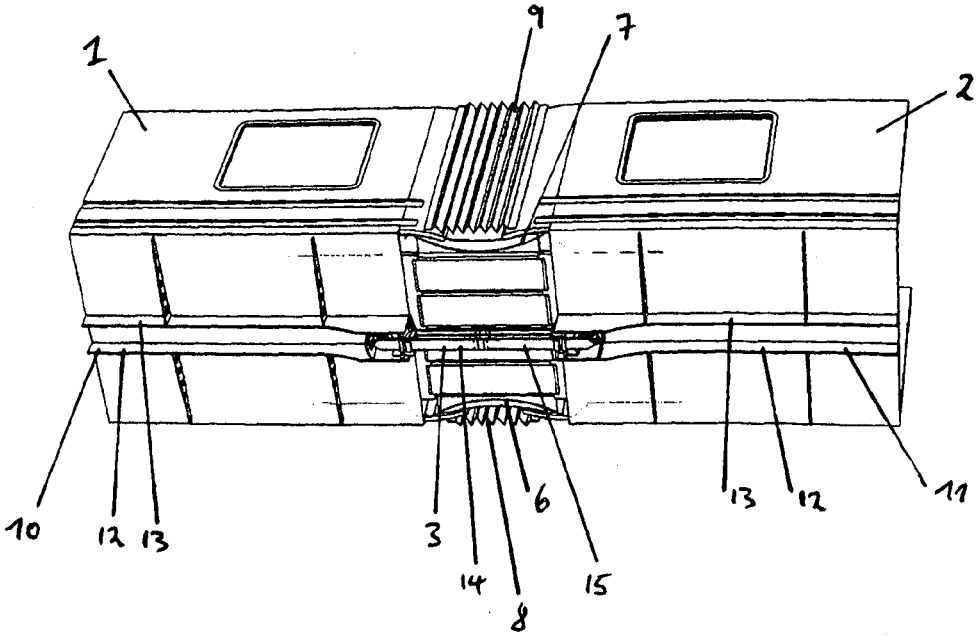
Figure 5:
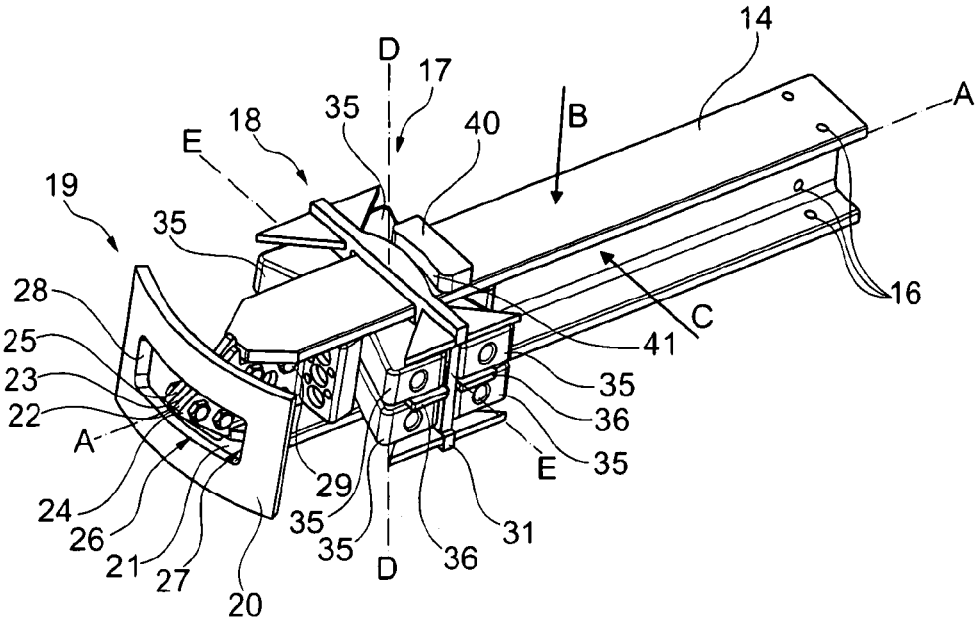
Figure 6:
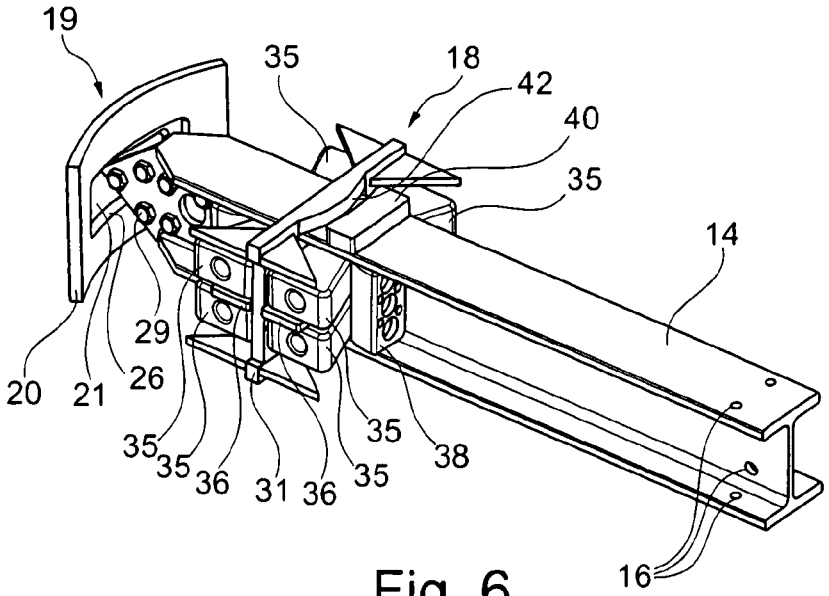
Figure 9:
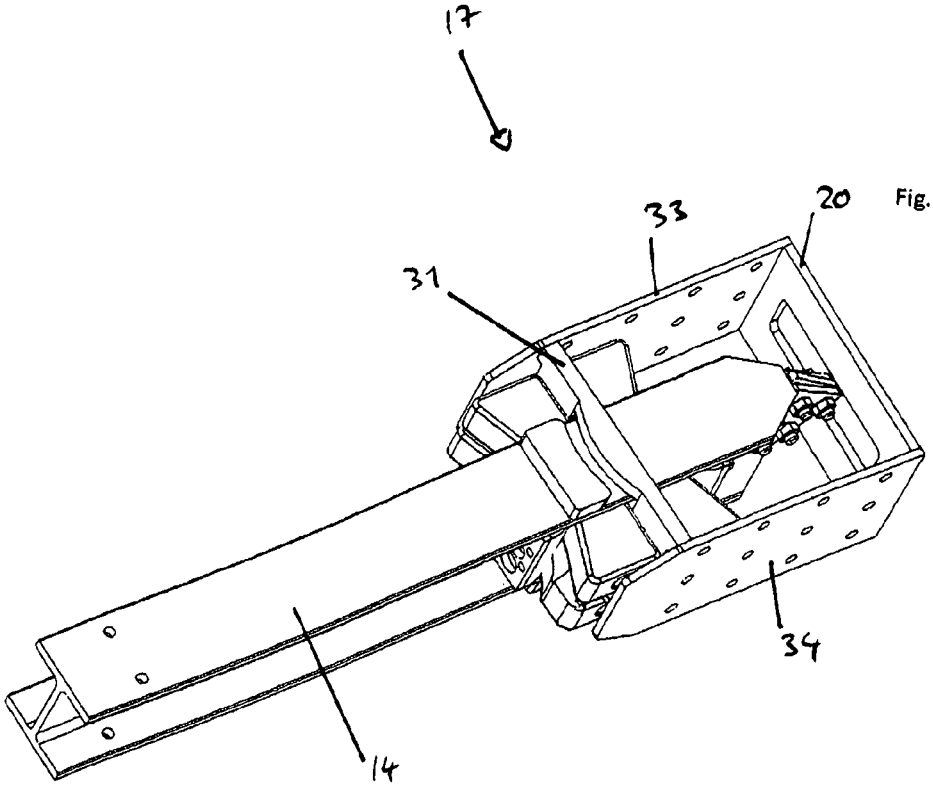
Figure 10:
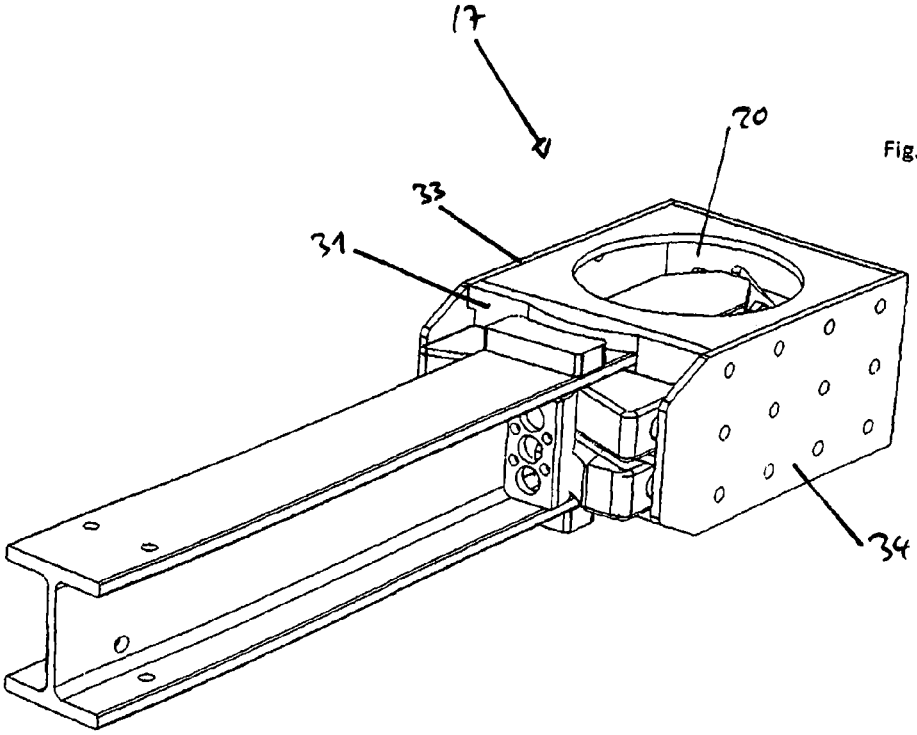
Figure 13:
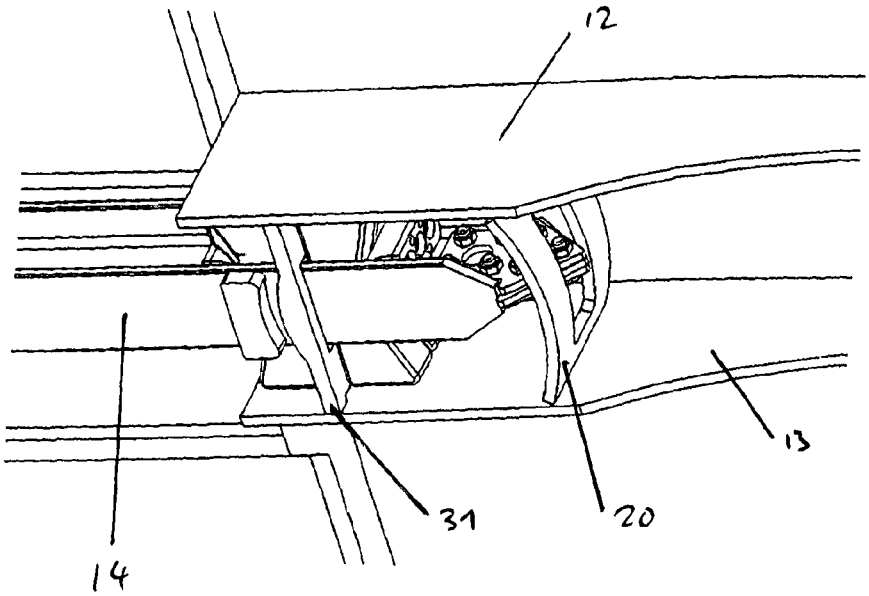
Figure 14:
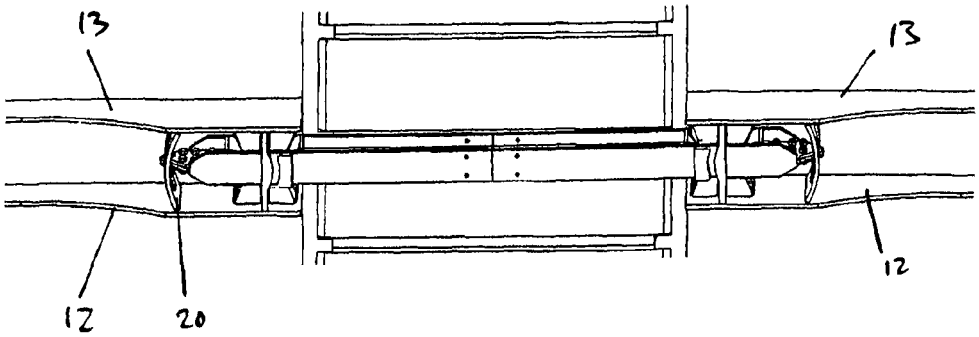
Figure 17:
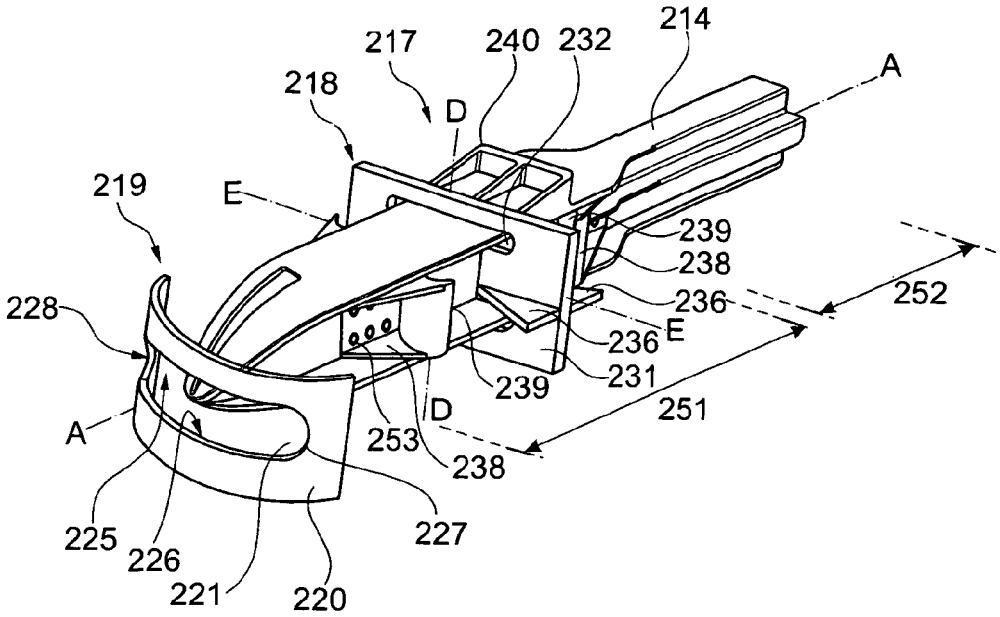
Figure 18:
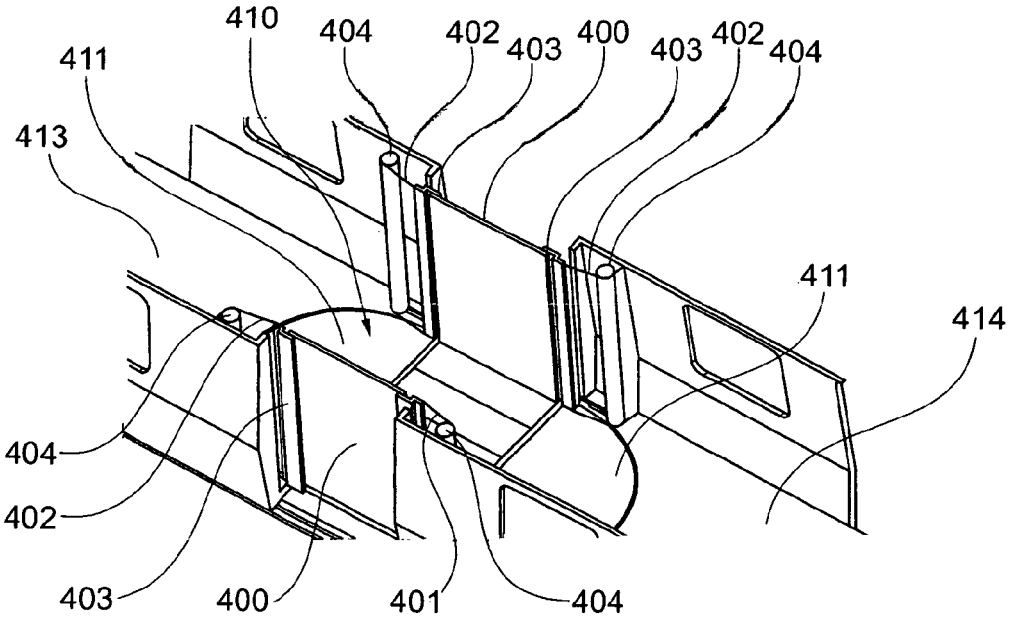
Figure 21:
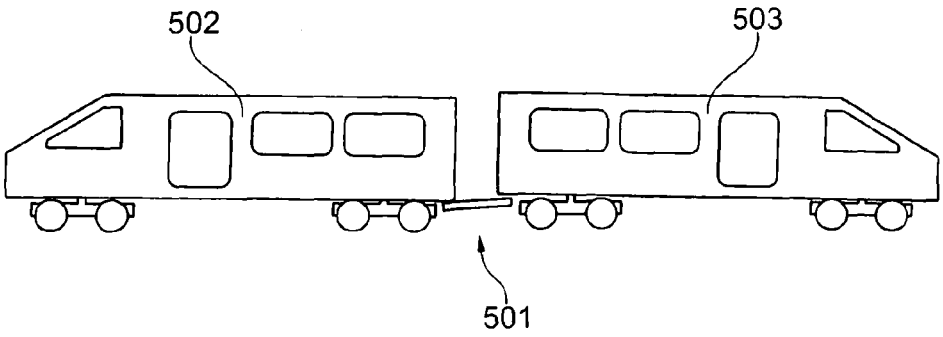
Figure 22:
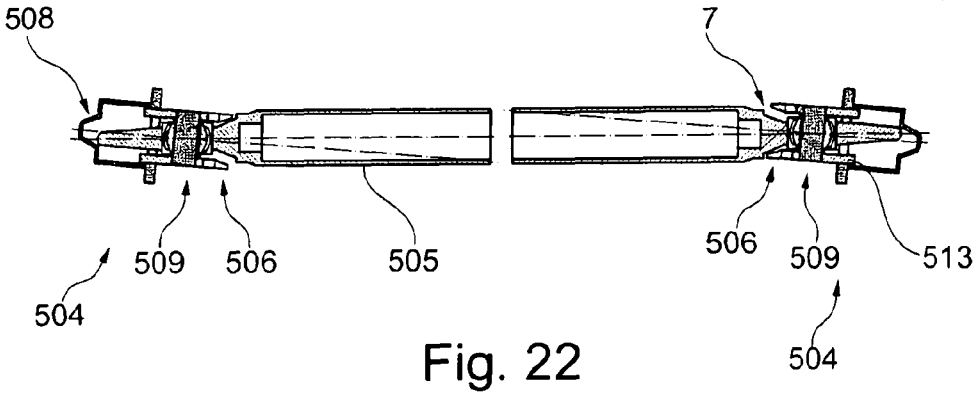
Figure 23:
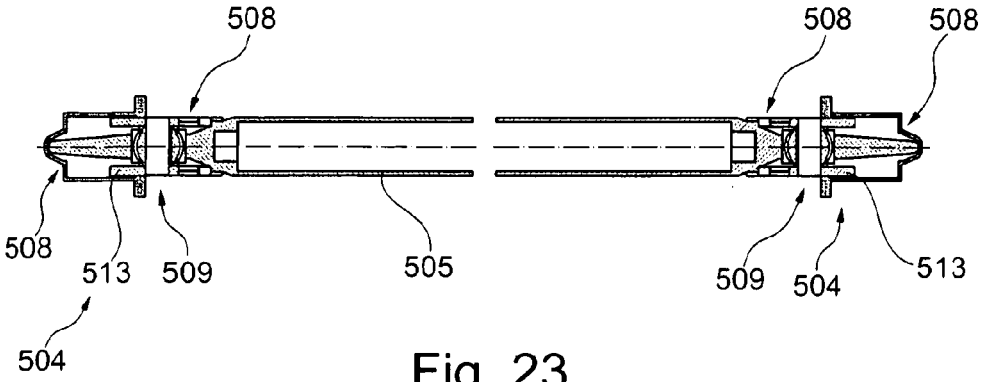
Figure 24:
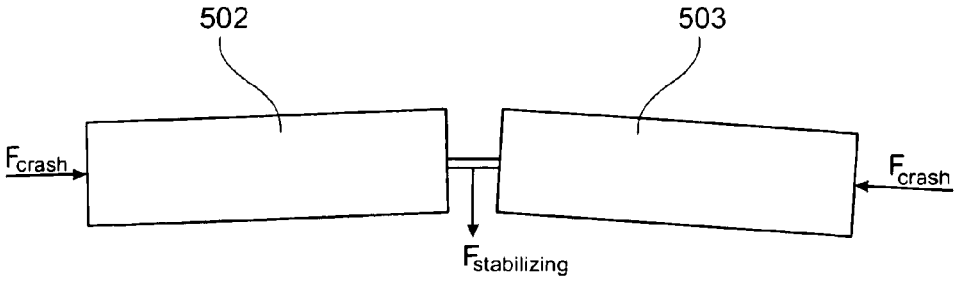
Figure 25:
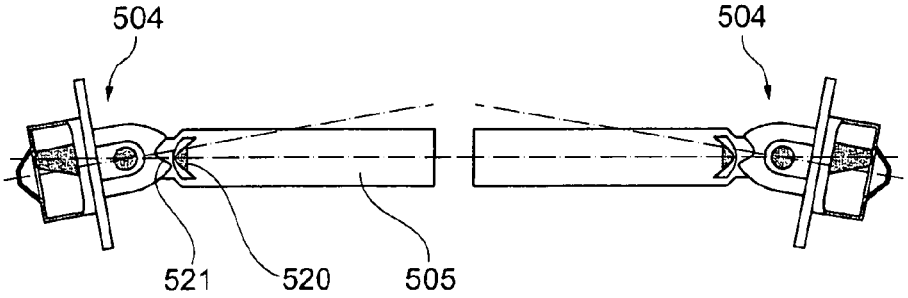
Figure 26:
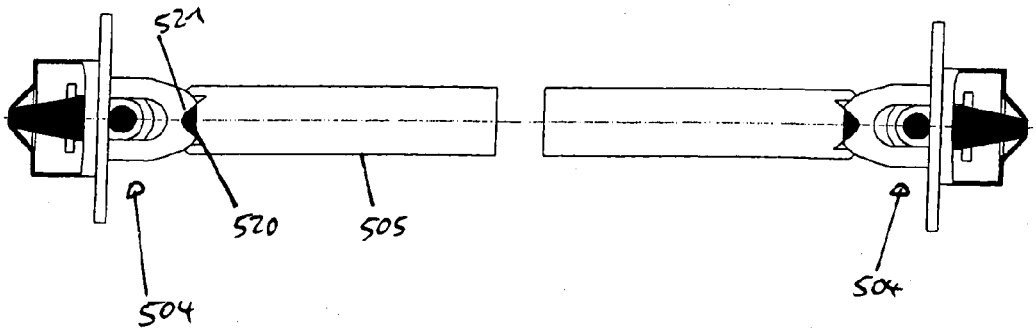
Figure 29:
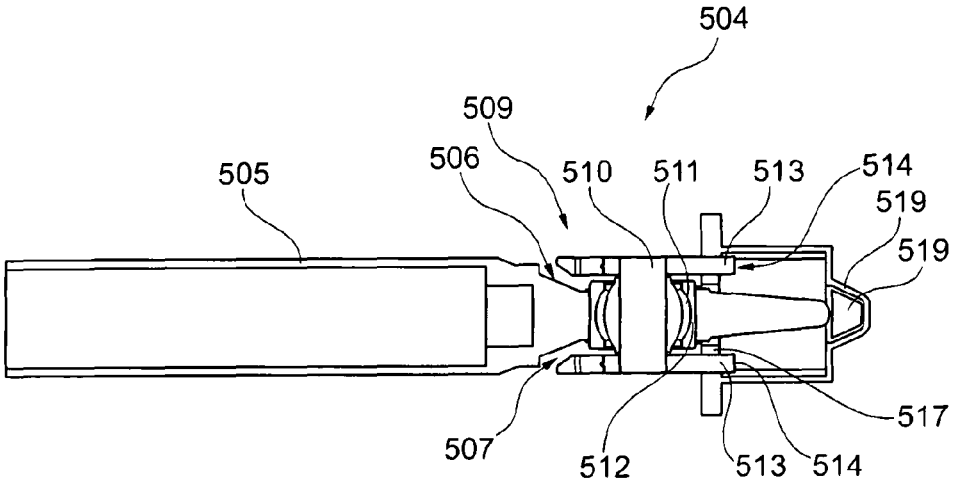

Below embodiments of the invention will be described with reference to the figures. The figures represent the following:

FIG. 1 a top perspective view onto the ends of a first car and a second car of a multi-car vehicle connected by a connecting device, the roof of the cars having been cut away for illustration purposes;

FIG. 2 a side view of the ends of a first car and a second car that are shown in FIG. 1;

FIG. 3 a further perspective view onto the ends of a first car and a second car that are shown in FIG. 1;

FIG. 4 a perspective view from below onto the ends of a first car and a second car that are shown in FIG. 1;

FIG. 5 a top perspective view onto the assembly of parts used in the connecting device shown in the FIGS. 2 and 4;

FIG. 6 a further top perspective view onto the assembly of parts used in the connecting device shown in the FIGS. 2 and 4;

FIG. 7 a side view onto the assembly of parts used in the connecting device shown in the FIGS. 2 and 4;

FIG. 8 a top perspective view onto the assembly of parts that can be used in the connecting device shown in FIGS. 2 and 4, whereby additional parts that can form the connection for connecting the bar to the first car are shown;

FIG. 9 a further top perspective view of the arrangement shown in FIG. 8;

FIG. 10 a further top perspective view of the arrangement shown in FIG. 8 now showing yet further parts that can form the connection for connecting the bar to the first car ar shown FIG. 11 a further top perspective view onto the assembly of parts used in the connecting device shown in the FIGS. 2 and 4;

FIG. 12 a front view onto the assembly of parts used in the connecting device shown in the FIGS. 2 and 4, the parts being shown as connected to the beams of the supporting frame;

FIG. 13 a perspective view from below onto the assembly of parts used in the connecting device shown in the FIGS. 2 and 4, the parts being shown as connected to the beams of the supporting frame;

FIG. 14 a perspective view from below onto the connecting device being connected to the first and the second car;

FIG. 15 a schematic perspective view of the gangway floor for a gangway between a first car of a multi-car vehicle and a second car of said vehicle;

FIG. 16 a schematic perspective view of the gangway floor arranged between the floor of the first car and the floor of the second car;

FIG. 17 a perspective view onto a further embodiment of the assembly of parts that can be used in a connection device FIG. 18, 19, 20 top perspective views onto the ends of a first car and a second car with a gangway arranged between them in different driving conditions FIG. 21 a side view of a multi-car vehicle comprising a first car and a second car connected by a connecting device in case of a crash with a climb component;

FIG. 22 a side view of the connecting device of FIG. 21 in the beginning of the crash;

FIG. 23 side view of the connecting device according to FIG. 22 after stabilizing;

FIG. 24 a top view of the multi-car vehicle of FIG. 21 in case of a crash with a jack-knife component;

FIG. 25 a top view of the connecting device of FIG. 24 in the beginning of the crash;

FIG. 26 a top view of the connecting device according to FIG. 25 after stabilizing;

FIG. 27 a perspective detail view of one end of the connecting device according to FIGS. 22, 23, 24, and 26 looked from the car's side;

FIG. 28 a perspective detail view of one end of the connecting device according to FIGS. 22, 23, 24, and 26 looked from the bar's side;

FIG. 29 a longitudinal cut along the bar through the detail view shown in FIGS. 27 and 28.

In the FIGS. 1-4 the view onto the end of a first car 1 and the end of a second car 2 of a multi-car vehicle are shown, the ends being connected by a connecting device 3. A gangway 4 is arranged between the first car 1 and the second car 2 of said vehicle. The gangway 4 has a gangway floor 5 and a first panel 6 and a second panel 7, both panels being arranged substantially vertical. Furthermore, the gangway 6 has bellows 8 and 9.

As can be best seen from FIG. 4, the first car 1 has a supporting frame 10 that supports the floor of the first car 1. Likewise, the second car 2 has a supporting frame 11 that supports the floor of the second car 2. The supporting frame 10, 11 is made up from beams. Of these beams, two centrally arranged, parallel beams 12, 13 are shown in FIG. 4. The respective supporting frame of the respective car will typically have more beams than the two beams 12, 13, the further beams not being shown here. The connecting device 3 is arranged between the beams 12, 13 of the first car 1 and the beams 12, 13 of the second car 2. The connecting device 3 has a first bar 14 that is suitable for transmitting a pulling force required to pull the first car 1 after the second car 2 and a pushing force required to push the first car 1 in front of the second car 2, when the second car 2 is moving. The connecting device 3 has a second bar 15 that is likewise suitable for transmitting a pulling force required to pull the first car 1 after the second car 2 and a pushing force required to push the first car 1 in front of the second car 2, when the second car 2 is moving. As can be seen from FIG. 2, the facing ends of bar 14 and bar 15 are connected to each other by means of screws and a connecting plate.

The embodiment of the invention will be described for a multi-car vehicle as it would be used with the second car 2 being driven or the engine for driving the multi-car vehicle being arranged on the side of the second car 2. The embodiment will thus be explained for the situation that the second car 2 is moved by an engine and whereby the connecting device 3 is used to pull the first car 1 behind the second car (for the cases, that the second car 2 is moved towards the right in the FIGS. 1, 2, 3, 4) or whereby the connection device 3 is used for pushing the first car 1 in front of the second car 2 (for the cases, where the second car 2 is moved towards the left in the FIGS. 1, 2, 3, 4). This choice of operational state does, however, not limit the scope of the invention. The invention is also applicable to multi-car vehicles, where the first car 1 is driven or where the engine is arranged on the side of the first car 1 or even for situations, where both, the first car 1 and the second car 2 are driven or where engines are arranged on both sides.

As can best be seen from FIG. 2 and FIG. 4, the bars 14 and 15 are arranged approximately at the same horizontal level as the beams 12, 13. The bars 14, 15 being connected to the beams 12, 13 are arranged approximately in the line of force of a horizontal force being transmitted along the beams 12, 13. This allows for horizontal forces being transmitted by the beams 12, 13 to be introduced into the beams 14, 15 directly horizontally. This provides the opportunity to leave out intermediate parts that would guide the horizontal forces transmitted by the bars 12, 13 into a different direction (vertical or slanted direction) first before introducing these forces into the connecting device and again diverting the forces from the vertical/slanted direction back into the horizontal direction by doing so.

The FIGS. 5-7 show the assembly of parts that are used as the left part of the connecting device 3 in the orientation of the connecting device 3 shown in FIGS. 2 and 4. The assembly of parts comprises the bar 14. This bar 14 has a longitudinal axis A. Provided at the free end of the bar 14 are holes 16. These holes 16 are suitable for being connected to a connecting plate by means of bolts inserted into the holes 16 for connecting this free end of the bar 14 to the bar 15 and thus to the right part of the connecting device 3. In other embodiments (not shown) a couple head could be connected to the bar 14 at this free end.

The assembly of parts has a connection 17 that is suitable to connect the bar 14 to the first car 1 and is suitable to transmit the pulling force and/or the pushing force from the bar 14 to the first car 1. The way of connecting the connection 17 to the beams 12, 13 will be described further below.

As can be seen from FIGS. 5-7, the bar 14 along almost its entire extend along its longitudinal axis A has a cross section in the plane perpendicular to the longitudinal axis A of the bar 14 that is I-shaped. The bar 14 therefore almost along its entire extent along its longitudinal axis A has a different bending stiffness in a first direction B that is perpendicular to the longitudinal axis A of the bar than in a second direction C that is perpendicular to the longitudinal axis A of the bar, whereby bending stiffness is understood to be the product of the elastic modulus E of the bar in that section and the area moment of inertia of the bar cross section in that section. As can be seen, the bar in its cross-section to which the longitudinal axis A is the normal vector has a cross-section that is I-shaped. Due to this I-shape the area moment of inertia I around a first axis B that lies in the plane of this cross-section is different to the area moment of inertia I around a second axis C that lies in the plane of this cross-section. Thus—assuming constant elastic modulus E—the bending stiffness in the first direction A is different to the bending stiffness in the second direction B.

The connection 17 comprises a first group of parts 18 and a second group of parts 19.

As part of the second group of parts 19 a plate 20 with a cut-out 21 formed as a longitudinal gap is provided. The bar 14 has an upward facing inclined surface and a downward facing inclined surface provided at the front section of the bar 14, which is the left section in the FIGS. 5, 6. The upwardly facing inclined surface (a first inclined surface) and the downwardly facing inclined surface (a second inclined surface) are provided by a wedge 22 provided at the front end section of the bar 14. The wedge 22 is designed in such a manner, that the upwardly facing inclined surface and the downwardly facing inclined surface are arranged symmetrically about the longitudinal axis A. The wedge 22 is also designed in such a manner, that the thickness of the wedge 22, which is understood to be the horizontal dimension of the wedge perpendicular to the longitudinal axis A of the bar 14, is smaller than the length of the upwardly facing inclined surface.

The second wedge 23 and the third wedge 24 are provided by a second triangular plate and a third triangular plate attached to the I-shaped section of the bar 14. The second wedge 23 and the third wedge 24 hold the first wedge 22 between each other. As can be best seen from FIG. 5, the inclined surfaces of the first wedge 22 have a different angle of inclination than the inclined surfaces of the second wedge 23 and the third wedge 24.

The cut-out 21 provided on the plate 20 is limited by two horizontally facing sidewalls and two vertically facing sidewalls. These sidewalls act as counter-surfaces 25, 26, 27, 28. The counter-surface 25 and the counter-surface 26 are arranged to come into contact with the inclined surfaces of the wedges 22, 23, 24 to prevent the bar 14 to move further in the vertical direction than the interaction between the inclined surfaces and the counter-surfaces 25, 26 allow. As will be described further below when describing the first group of parts 18 in more detail, the bar 14 is held by the elements of the first group of elements 18 in such a manner that it can swivel about the vertical axis D and also about the horizontal axis E. As can be best seen from FIG. 5, a swivel movement about the horizontal axis E can for example be a movement whereby the free end of the bar 14 that contains the holes 16 is pushed downwards that will lead to the front end section of the bar 14 to be pushed upwards. This swivel movement upwards is limited to the point, where the inclined surfaces of the wedges 22, 23, 24 contact the contact surface 25. The inclined surface of the wedge 22 that has the steeper inclination will contact the counter-surface 25 first. Depending on the force that initiates the swivel movement of the bar 14 about the horizontal axis E the inclined surface of the wedge 22 might deform the counter-surface 25 and allow for yet more upward movement of the front end section of the bar 14 and for the inclined surfaces of the wedges 23 and 24 to contact the counter-surface 25. Likewise, if the free end of the bar 14 that contains the holes 16 is moved upwardly, this will lead to a downward movement of the front end section of the bar 14 and for the downwardly facing inclined surface of the wedge 22 to contact the counter-surface 26.

As will be described further below with reference to the first group of parts 18, the parts of the first group of parts 18 are designed to hold the bar 14 during normal operating conditions of the multi-car vehicle. In crash situations, which are understood among others to be situations, where a horizontal force above a predetermined limit is applied to the bar 14, the elements of the first group of parts 18 will be partially destructed and will allow the bar 14 to travel along its longitudinal axis A. In such a crash-situation, the wedges 22, 23, 24 will be rammed into the cut-out 21 and will expand the cut-out 21. The energy necessary to expand the cut-out 21 helps to dissipate the crash-energy introduced by the large force applied to the bar 14 and therefore helps to dissipate the crash-energy within the multi-car vehicle system. The ability to absorb energy can be enhanced by providing a second plate parallel to the first plate 20 that can be of similar shape to the first plate 20. This second plate (not shown in the Fig.) can be arranged behind the first plate 20 with regard to the bar 14 being arranged in front of the plate 20. This second plate could be made of a different material relative to the material of the first plate 20, for example a material that is even more suitable for absorbing energy when being widened as it will be widened by the wedges 22, 23, 24 being pushed into its cut-out and widening the cut-out of said second plate.

As will be explained in further detail below with regard to the elements of the first group of elements 18, these elements allow the bar 14 to swivel about the vertical axis D. This is allowed for by the bar 14 being passed through a plate 31 that has a hole 32.

As can be seen from the FIGS. 5-7, the plate 20 is arch-shaped. The radius of the arch equals the distance along the longitudinal axis of the bar from the hole 32 in the plate 31 to the plate 20 with the cut-out 21. This allows for the delimiting function of the counter-surfaces 25 and 26 with regard to vertical movements of the front end of the bar 14 to be likewise operational in operational states, where the bar 14 is not perfectly aligned but has swiveled about the vertical axis D, for example when the multi-car vehicle is driving around a bend. Likewise, the arch-shape of the plate 20 enhances the limiting function of the counter-surfaces 27, 28. These are arranged to limit the swivel-movement of the bar 14 about the vertical axis D. The arch-shape of the plate 20 ensures that the tip of the wedges 22, 23 and 24 will definitely contact the counter-surfaces 27 or 28 in those cases, where the bar 14 has swiveled about the vertical axis D by the required amount.

The plate 20 with the cut-out 21 is preferably arranged at a horizontal distance that is larger than 1 times the maximum distance across the bar in the plane perpendicular to the longitudinal axis. The horizontal distance is preferably larger than 1.5 times. The horizontal distance is preferably understood to be the distance along the horizontal axis A of the bar 14 in the operational situation as shown in FIG. 5, the distance being the distance from the point where the horizontal axis A intersects the vertical axis D to the point where the horizontal axis A of the bar 14 intersects with the (possibly curved) plane of the surface of the plate 20 that faces towards the bar 14 and the first group of elements 18. The larger the horizontal distance of the plate 20 relative to the plate 31 is, the better the counter-surfaces 25 and 26 can limit the vertical movements of the bar 14 to small angles. If the cut-out 21 is kept at the same size, moving the plate 20 closer to the horizontal axis E allows for larger vertical swivel angles of the bar 14 about the horizontal axis E compared to situations, where the plate 20 is moved further away from the horizontal axis E.

The FIGS. 8 to 10 show a further embodiment of the assembly of parts suitable to be used as part of a connecting device 3. The embodiment shown in the FIGS. 8 to 10 in the majority of parts is identical to the embodiment shown and described above with regard to the FIGS. 5-7. The embodiment shown in the FIGS. 8 to 10 does, however, make use of a cut-out that is plane and not arch-shaped. Furthermore, the embodiment shown in FIGS. 8 to 10 shows two side-plates 33, 34. These side-plates 33, 34 are connected to the plate 31 and the plate 20. Together the four plates (plate 20, plate 31, plate 33, plate 34) form a box. This box can be used to connect the assembly of parts to the beams 12, 13 of the supporting frame 10, 11. As can best be seen in FIG. 10, the side-plates 33, 34 contain holes that can be used for bolts to connect the box to the beams 12, 13. The use of the side-plates 33, 34 is not limited to the plate 20 being plane and not arch-shaped. The side-plates 33, 34 can also be used in conjunction with the embodiment as described with the FIGS. 5-7.

FIG. 11 shows the assembly of parts as described with reference to the FIGS. 5-7 in yet another top perspective view.

FIG. 12 shows an embodiment, in which the assembly of parts is connected to the beams 12, 13 of the supporting frame 10 by means of welding. FIG. 12 shows the floor of the car 1 and the beam 12 and 13 of the supporting frame that supports the floor. FIG. 12 shows the arch-shaped plate 20 to be directly contacted to the beams 12, 13. This can be achieved by welding the arch-shaped plate 20 onto the beams 12, 13.

FIG. 13 shows the arrangement of FIG. 12 in a perspective view from below. From FIG. 13, it can also be seen, that the plate 31 is welded to the beams 12, 13.)

The FIG. 14 shows a perspective view of the connecting device being connected to the first car and the second car. Again, it can be seen that the plate 20 and the plate 31 are welded to the beams 12, 13 of the supporting frame of the respective floor of the respective cars. Also, it can be seen from these Figs. once more that the bar 14 and the bar 15 are arranged approximately at the same level as the beams 12, 13.

As shown especially in the FIGS. 5-7, the connection 17 has a first group of elements 18. This first group of elements has a plate 31 that has a hole 32, through which the bar 14 passes. The hole 32 is big enough so that the bar 14 can pass through the hole 32 without touching the sidewalls delimiting the hole 32. The hole 32 is I-shaped, the same shape as the cross section of the bar 14, larger of course, to allow the bar to pass through the hole without touching the sidewalls delimiting the hole and giving it its I-shape.

The hole 32 being larger than the cross section of the bar 14 in this section gives the bar 14 the possibility to swivel about a vertical axis D and about a horizontal axis E.

To allow for this vertical and to allow for this horizontal swivel movement, the bar 14 should be held in such a position that it passes through the hole without touching the sidewalls delimiting the hole. For holding the bar 14 in the desired vertical position, the connection 17 comprises vertical limitation parts in the form of 16 rubber elements 35. These rubber elements 35 are arranged in such a manner that the substantially horizontally and inward facing surfaces of the bar 14 in the region of the plate 31 can come into contact with the horizontally facing surfaces of the rubbers 35. The rubbers 35 themselves are connected to horizontal plates 36, which again are connected to the plate 31. The substantially horizontally facing surfaces of the rubbers 35 are thus pre-set in relation to the vertical extent of the plate 31 and thus the hole 32. Thus, by contact of the horizontally facing surfaces of the bar 14 with the horizontally facing surfaces of the rubbers 35 the position of the bar 14 can be set in relation to the plate 31 and the hole 32. Depending on the choice of rubber for the rubber elements 35 and the elastic deformation characteristics as well as depending on which movements of the bar 14 in the region of the plate 31 in the vertical direction are to be allowed, the assembly of parts can be assembled in such a manner, that the rubber elements are pre-tensioned (have already been compacted by a certain amount relative to the state they would take up, if no forces were asserted onto them).

The rubber elements can thus damp the vertical movement of the bar 14 in the region of the plate 31 and can ultimately limit the vertical movement of the bar 14 in normal operating conditions. The ultimate limit of the vertical movement of the section of the bar 14 in the region of the plate 31 can also be provided by the bar 14 contacting the sidewalls that delimit the hole 32.

The horizontal plates 36 have side surfaces that extend at an angle away from the longitudinal axis A of the bar. As already described, the bar 14 is allowed to swivel about a vertical axis D. In order to allow for this swivel movement and not to limit the swivel movement due to a contact with the horizontal plates 36, the horizontal plates 36 have the side surfaces that extend at an angle away from the longitudinal axis A of the bar 14 and thus give room for the swivel movement of the bar 14 about the vertical axis D.

Similar to providing vertical limitation parts that limit the vertical movement of a section of the horizontally extending bar, namely in the area of the plate 31, the first group of elements 18 of the connection 17 comprises a lateral limitation part that limits the sideways movement of the section of the bar 14 in the region of the plate 31. The lateral limitation part is provided by the vertically facing surfaces 37 of the rubbers 35 that face towards the bar 14. The rubber elements 35 being connected to the horizontal plates 36 and thus being connected to the plate 31 and limited in their horizontal movements perpendicular to the longitudinal axis A of the bar 14 lead to the horizontally facing surfaces of the rubbers 35 that face the bar 14 to be positioned at a predetermined position. If the bar 14 contacts these surfaces 37, the movement of the bar 14 in the sideways direction (in the horizontal direction perpendicular to its longitudinal axis A) is limited. Again, these rubbers 35 can be built in to be also pre-tensioned in the horizontal direction.

By means of axial limitation parts the axial movement of the bar 14 along its longitudinal axis A relative to the plate 31 that has a hole 32 is limited in the forward as well as in the rearward direction of the bar 14. These axial limitation parts are provided by elements 38 that are connected to the bar 14. The elements 38 have a surface 39 that extends away from the longitudinal axis of the bar 14 in an angle between 0° and (including) 90°. By contact of the surface 39 with the side surfaces of the rubber elements 35, the axial movement of the bar 14 along its longitudinal axis A is limited. This axial limitation could already be achieved by a surface that extends at 90° from the longitudinal axis of the bar. The embodiment does however have a surface 39 that bends away in a manner that the tangent of the surface is at a larger angle relative to the longitudinal axis A for those parts of the surface 39 that are closer to the longitudinal axis A and that the tangent of the surface is at a smaller angle relative to the longitudinal axis A for those parts of the surface 39 that are further away from the longitudinal axis. This specific shape of the surface 39 also allows for a good swivel movement of the bar 14 about the vertical axis D. Likewise, the surfaces 39 can operate as additional lateral limitation parts. The sideways facing surfaces of the rubber element 35 being arranged at an angle can interact with the surfaces 39 in a manner that also limits the sideways movement of the bar 14. Thus, the elements 38 also support the lateral limitation function provided by the horizontally facing surfaces 37 of the rubber elements. Finally, the shape of the surface 39 can be used to limit the swivel angle about which the bar 14 is allowed to swivel about the vertical axis D.

The elements 38 are attached to the bar 14 by means of welding. The welding is done in such a manner that the weld will break, if a pre-set level of axial forcing acting along the longitudinal axis A of the bar 14 is reached. For a crash situation, in which the bar 14 is pushed by a horizontal force acting along its longitudinal axis A from the right towards the left in the FIGS. 5, 6, the elements 38 arranged on the right-hand side of the plate 31 limit any axial movement that this force would cause up to a certain force-level. If the force exceeds this pre-set level, the elements 38 will break away from the bar 14. This leads to the situation that the bar 14 is not limited in its axial movement towards the left any more. This will lead to the wedges 22, 23, 24 to come into contact with the surfaces delimiting the cut-out 21 of the plate 20 and to start to deform the plate 20. This deformation of the plate 20 will lead to energy being dissipated.

As part of the first group of elements 18 a guiding element 40 is provided that has a guiding surface 41, which acts as a further axial limitation part. The plate 31 has a guiding surface 42. The guiding surfaces are arranged in such a manner that they can cooperate upon contact in such a manner to allow swiveling movements about a vertical axis, but prevent axial and sideways movements of the bar 14 relative to the plate 31. The guide surfaces 41 and 42 are arranged at a distance to one another in the normal operating state as shown in the FIGS. 5, 6. In the crash situation above, where the elements 38 arranged on the right-hand side of the plate 31 break away, the bar 14 will move towards the left in the FIGS. 5, 6. This will bring the guide surfaces 41 and 42 into contact with one another and will bring them into operation, namely will limit any further movement of the bar 14 towards the left (axial limitation), but allows the bar 14 to swivel about a vertical axis D. Preferably, the guiding element 40 will be arranged at such an axial position along the longitudinal axis A of the bar 14 that corresponds with the maximum deformation of the plate 20 that the wedges 22, 23, 24 can achieve. The guiding element 40 will be placed at such a position that the wedges 22, 23, 24 interlock with the plate 20, but do not cut through the plate 20. This interlocking of the wedges 22, 23, 24 with the plate 20 will allow for the multi-car vehicle to still be pulled by the bar 14, if the vehicle is to be moved towards the right. The interaction of the guiding element 40 with the plate 31 will allow the vehicle to be pushed into the direction towards the left. The cooperation of the guide surface 41 with the guide surface 42 allowing for swivel movements about the vertical axis will allow such a vehicle to still be driven around bends. This arrangement thus ensures that the cars of the multi-car vehicle still are kept connected to one another, if the vehicle is to be moved from a crash.

FIG. 15 shows a gangway floor 100 for the gangway 4 between the first car 1 and the second car 2. The gangway floor comprises a first panel 101 that has the shape of a segment of a circle. The gangway floor 100 also includes a second panel 102 that has the shape of a segment of a circle. The circle of which the panel 101, 102 form segments of has a radius R. As can be seen from FIG. 16, the gangway floor is arranged between the floor 103 of the first car 1 and the floor 104 of the second car 2. As can also be seen from FIG. 16, the radius R of the circle of which the floor panel 101 forms a segment of as well as the radius R of the circle of which the floor panel 102 forms a segment of is larger than 25% of the width W of the first car 1 and the second car 2. The radius R is larger than 45% of W and approximately about 48% of W. Arranged between the floor panel 101 and the floor panel 102 are four rectangular floor panels 105. The connection of the rectangular floor panels 105 to the panel 101 and the panel 102 is provided by means of a hinged connection 106. The hinged connection is obtained by the rectangular floor panels 105 having a tubular channel 107. An axle is arranged between projecting parts 108 of the panel 101, 102. This axle will be arranged inside the tubular channel 107 in the rectangular plate 105 and will thereby allow the rectangular floor panel 105 to swivel relative to the first panel 101 and the second panel 102 about the axis of this axle. If a rubber tubular member is introduced into the tubular channel 107 and the axle is then introduced into the tubular rubber element, the rectangular floor panels will also be able to swivel about an axis perpendicular to the line of connection between the rectangular panels and the panels 101, 102.

As can be seen from FIG. 15, damping elements 109 can further be provided that allow for some relative movement between the panels 102, 101 and the rectangular panels 105. As can be seen in FIG. 15, these damping elements 109 can be arranged on the same side.

The rectangular floor panels 105 are made from rubber reinforced by metal objects.

As can be seen from FIG. 15, the first floor panel 101 is arranged to rotate about a first axis F and the second floor panel 102 is arranged to rotate about a second axis G. The distance between the first axis and the second axis is 1.5 times the radius R of the circle of which the floor panel 101 and the floor panel 102 form a segment of.

The first panel 101 is set into a cut-out in a connector plate 110. The first plate 101 is horizontally supported by the connector plate 110. Likewise, the second panel 102 is set into the cut-out of a further connector plate 111 and is horizontally supported by this connector plate 111.

As can be seen from FIG. 16, the connector plates 110 and 111 are set into the floors 104 and 103 of the first car 1 and the second car 2. The arrangement of the connector plates 110, 111 into the floors 103, 104 can be further enhanced by introducing spring-elements or damping elements 112 between the connector plates 110, 111 and the floors 103, 104.

The gangway floor is such arranged in relation to the assembly of parts that make up part of the connecting device that the respective vertical swivel axle D of the first group of elements 18 as shown in FIG. 5 is in line the axis G. Likewise, the axis F is in line with the vertical swivel axis D of the assembly of parts that form part of the right-hand connecting device.

FIG. 17 shows a perspective view onto a further embodiment of the assembly of parts that can be used in a connection device. In its basic design, this embodiment is similar to the embodiment described with reference to the FIGS. 5 to 7. To simplify the drawing, FIG. 17 shows the assembly of party without showing rubber elements like the rubber elements 75 shown in the embodiment of FIGS. 5 to 7. To complete the assembly of parts, appropriate rubber elements are placed in a similar manner compared to the placement of the rubber elements 35 in the embodiment shown in the FIGS. 5 to 7.

To simplify the reference, parts similar to party of the embodiment shown with reference to the FIGS. 5 to 7 have been numbered with the same reference numbers as used for the description of the embodiment shown with reference to be FIGS. 5 to 7, but having been increased by the value of 200.

The embodiment shown in FIG. 17, the assembly of party shown in that particular embodiment has a bar 214 that hat a longitudinal axis A. The assembly of parts has a connection 217 that is suitable to connect the bar 214 to the first car 1 and is suitable to transmit the pulling force and/or the pushing force from the bar 214 to the first car 1. For a first section 251 along its longitudinal axis a the bar 14 has a cross section in the plane perpendicular to the longitudinal axis A of the bar 214 that is I-shaped. For a second section 252 along its longitudinal axis A the bar 214 has a cross section in the plane perpendicular to the longitudinal axis A of the bar 214 that has the shape of a hollow cross.

The connection 217 comprises a first group of parts 218 and a second group of parts 219. As part of the second group of parts 219 a plate 220 is provided with a cut-out 221 formed as a longitudinal gap. The bar 214 has an upwards facing inclined surface and a downward facing inclined surface provided at the front section of the bar 214. The upwardly facing inclined surface (a first inclined surface) and the downwardly facing inclined surface (a second inclined surface) are provided by bending the front section of the I-section 251 of the bar 214 in the manner shown in FIG. 17. This shows, that within the invention, inclined surfaces are also understood to be provided by providing curved surfaced.

The cut-out 221 provided on the plate 220 is limited by two horizontally facing sidewalls and to vertically facing sidewalls. These sidewalls act as counter-surfaces 225, 226, 227, 228. The counter-surface 225 and the counter-surface 226 are arranged to come into contact with the inclined surfaces to prevent the bar 214 to move further in the vertical direction than the interaction between the inclined surfaced and the counter-surfaced 225, 226 allow. The swivel movement of the bar 214 about the horizontal axis E will thus be limited to the point, where the inclined surfaces contact the contact-surface 225 for those cases, where the bar 214 has moved along its longitudinal axis A towards the plate 220.

The first group of parts 218 is designed to hold the bar 214 during normal operating conditions of the multi-car vehicle. In crash situations, the elements of the first group of parts 218 will be partially destructed and will allow the bar 214 to travel along its longitudinal axis a. In such a crash situation, the front end of the bar will be rammed into the cut-out 221 and will expand the cut-out 221. The elements of the first group of elements 218 also allow the bar 214 to swivel about the vertical axis D. The plate 220 is arch-shaped. The radius of the arch equals the distance along the longitudinal axis of the bar from the hole 232 in the plate 231 to the plate 220 with the cut-out 221. This allows for the delimiting function of the counter-surfaces 227, 228. These are arranged to limit this swivel movement of the bar 214 about the vertical axis D.

The first group of elements has a plate 231 and has a hole 232 through which the bar 214 passes. The hole 232 is big enough so that the bar 214 can pass through the hole 232 without touching the sidewalls delimiting the hole 232. The hole 232 is I-shaped, the same shape as the cross section of the bar 214, larger of course, to allow the bar 214 to pass through the hole 232 without touching the sidewalls delimiting the hole 232 and giving it its I-shape. The hole 232 being larger than the cross section of the bar 214 and this sections gives the bar 214 the possibility to swivel about the vertical axis D and about a horizontal axis E.

The bar 214 is held in such a position that is passes through the hole 232 without touching the sidewalls delimiting the hole 232. For holding the bar in the desired vertical position the connection 217 comprises vertical limitation parts in form of rubber elements not shown in FIG. 17. The rubber elements are arranged is such a manner that the substantially horizontally and inward facing surfaces of the bar 214 in the region of the plate 231 can come into contact with the horizontally facing surfaces of the rubbers. The rubbers themselves are connected to horizontal plates 236, which again are connected to the plate 231. The substantially horizontally facing surfaces of the rubbers are thus pre-set in relation to the vertical extend of the plate 31 of thus the hole 32. Thus, by contact the horizontally facing surfaces of the bar 214 with the horizontally facing surfaces of the rubbers the position of the bar 214 can be set in relation to the plate 231 and the hole 232. The horizontal plates 236 have side surfaces that extend at an angle away from the longitudinal axis a of the bar. This assists to allow the bar 214 to swivel about the vertical axis d.

The first group of elements 218 of the connection 217 also comprise lateral limitation parts that limit the sidewards movement of the section of the bar 214 in the region of the plate 231. The lateral limitation part is provided by the vertically facing surfaces of the rubbers (not shown in FIG. 17) that face towards the bar 214. The rubber elements being connected to the horizontal plate 236 and thus be connected to the plate 231 and limited in their horizontal movements perpendicular to the longitudinal axis A of the bar 214 lead to the horizontally facing surfaces of the rubbers that face the bar 214 to be positioned at a predetermined position. If the bar 214 contacts these surfaces, the movement of the bar 214 in the side-wards direction (in the horizontal direction perpendicular to the longitudinal axis A) is limited.

The first group of elements 218 also has two type of axial limitation parts. One type of axial limitation part is provided by elements 238 that are connected to a bar 214. Both the elements 238 have surfaces 239 that face towards the rubber elements (not shown) attached to the horizontal plate 236. The contact of the surfaces 239 with the side-surfaces of the rubber elements (not shown), the axial movement of the bar 214 along as the longitudinal axis A. The elements 238 are attached the bar 214 by means of screws 253. The screws are chosen is such a manner that the screws will break if a pre-set level of axial force acting along the longitudinal axis A of the bar 214 is reached. For a crash situation, in which the bar 214 is pushed by a horizontal force acting along its longitudinal axis A from the right to the left in FIG. 17, the elements 238 arranged on the right hand side of the plate 231 limit any axial movement that this force would cause up to certain force-level. If the force exceed the pre-set level, the elements 238 arranged on the right hand side of the plate 231 will break away from the bar. This leads to the situation that the bar 214 is not limited in its axial movement towards the left anymore.

This will lead to the inclined surfaces and the front of the bar to contact with the surface delimiting the cut-out 221 of the plate 220 and it start to deform the plate 220. This deformation of the plate 220 will lead to energy being dissipated.

As part of the first group of elements 18 a further axial limitation part 240 (guiding element 240) is provided. The axial limitation part 240 by a protruding element that protrudes from the bar. The protruding element is arranged at a position along the longitudinal axis of the bar that is distant from the plate that has a hole in, but which is yet again arranged close enough to the plate that has a hole in to come into contact with the plate that has a hole in driving conditions, where the bar has been displaced in a direction along its longitudinal axis, for example in a crash situation. The protruding means are wedges shaped with the slim end pointing towards the plate that has a hole in and the thick end pointing away from the plate that has a hole in. The slim end of the wedge is of a size that allows the wedge to partially enter into the space between the bar and the wall that delimits the hole in the plate. Several wedges are provided parallel to one another. By providing two slim wedges that are aligned in parallel, the effect of placing a rotational moment onto the bar can be achieved, namely when the first wedge enters into the gap between the bar and the walls limiting the hole prior to the second wedge entering into this gap.

Figure 19:
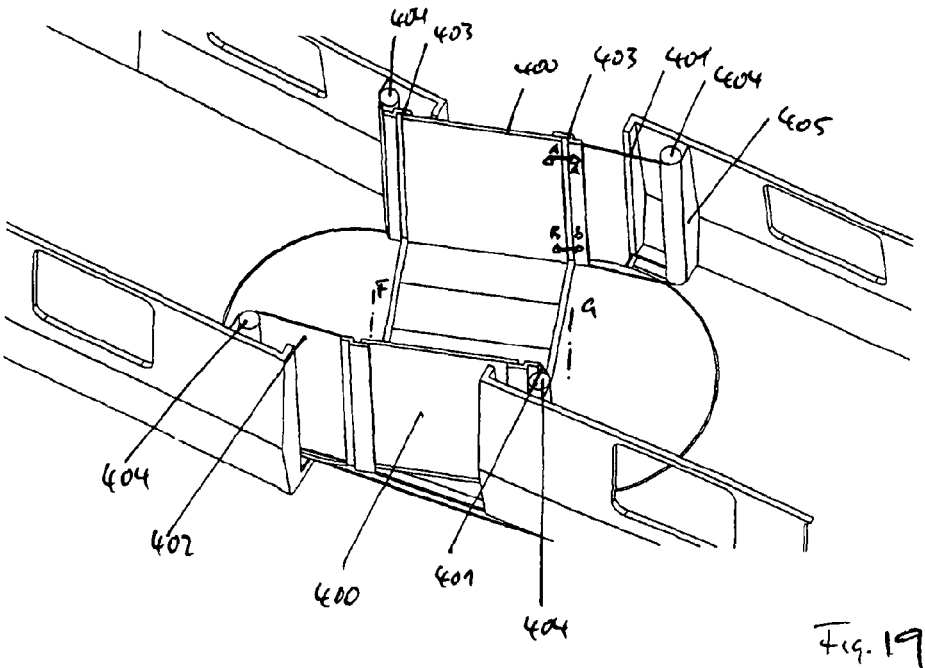
Figure 20:
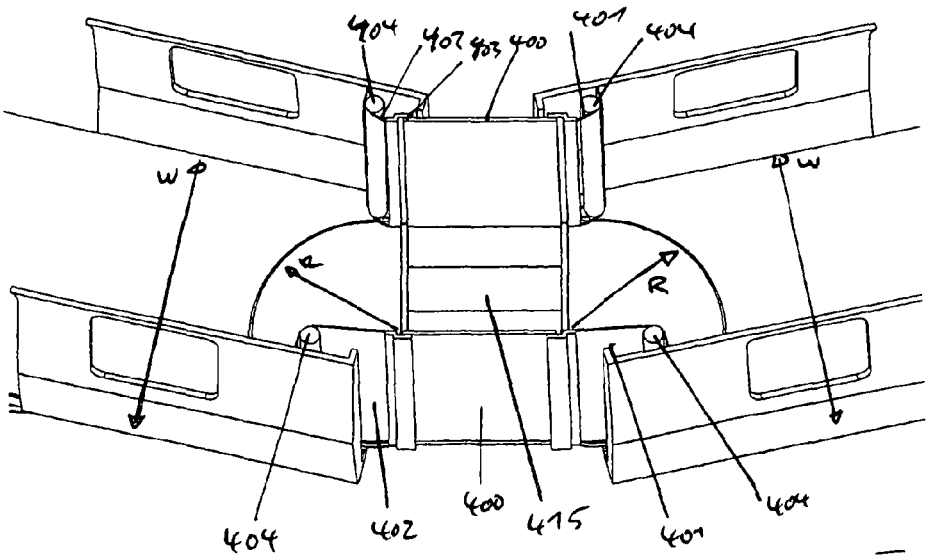

The embodiment shown in FIGS. 18 to 20 make use of a middle, rigid side panel 400 arranged on either side of the rigid middle side panel 400 is a side panel 401 and 402 according to the invention. The two side panels according to the invention (401, 402) and the middle rigid side panel 400 make up together the side wall of the gangway. The side panels 401, 402 are provided with second connections 403. This second connection connects the side panels 401, 402 respectively to the rigid middle side panel 400. This second connection 403 can be made to allow the rigid panel 400 to tilt relative to the side panels 401, 402. For example the second connection 403 can allow the top parts of the side panels 401, 402 to spread in the direction of the arrows A further apart from each other then the bottom of the side panels as indicated by the arrows B.

The side panels 401, 402 have first connections 404. These first connections have support elements in form of a cylinder, which allow the flexible section of the side panel to be wrapped around this cylinder. The first connection 404 is connected to the floor of the respective car. A deflecting element 405 is provided sideways to each first connection to prevent objects to be pulled along the side panel when it is being wrapped up around the cylinder.

A gangway floor 410 for the gangway comprises a first panel 411 that has the shape of a segment of a circle. The gangway floor 410 also includes a second panel 412 that has the shape of a segment of a circle. The circle of which the panel 411, 412 form segments of has a radius R. As can be seen, the gangway floor is arranged between the floor 413 of the first car and the floor 414 of the second car. The radius R of the circle of which the floor panel 411 forms a segment of as well as the radius R of the circle of which the floor panel 412 forms a segment of is larger than 25% of the width W of the first car and the second car. The radius R is larger than 45% of W and approximately about 48% of W. Arranged between the floor panel 411 and the floor panel 412 are rectangular floor panels 415. The connection of the rectangular floor panels 415 to the panel 411 and the panel 412 is provided by means of a hinged connection. The hinged connection is obtained by the rectangular floor panels 415 having a tubular channel. An axle is arranged between projecting parts of the panel 411, 412. This axle will be arranged inside the tubular channel in the rectangular plate 215 and will thereby allow the rectangular floor panel 415 to swivel relative to the first panel 411 and the second panel 412 about the axis of this axle. If a rubber tubular member is introduced into the tubular channel and the axle is then introduced into the tubular rubber element, the rectangular floor panels will also be able to swivel about an axis perpendicular to the line of connection between the rectangular panels and the panels 411, 412.

The rectangular floor panels 415 are made from rubber reinforced by metal objects.

As can be seen from FIG. 19, the first floor panel 411 is arranged to rotate about a first axis F and the second floor panel 412 is arranged to rotate about a second axis G. The distance between the first axis and the second axis is 1.5 times the radius R of the circle of which the floor panel 411 and the floor panel 412 form a segment of.

In the FIGS. 21 to 29 for reasons of simplicity, the bar 505 is drawn in a ring shape. It is understood that this bar can also be implemented with a not ring-shaped and not circular shaped bar. For example with a bar shaped in a cross-section as shown in any one of FIG. 5, 6, 7, 8, 9, 10, 11, 12, 13, 14.

In FIGS. 21 to 29 a connecting device according to the invention will be described.

It is provided: An assembly of parts suitable to be used as part of a connecting device 501 for connecting a first car 502 of a multi-car vehicle with a second car 503 of said vehicle, comprising: a bar 505 suitable for transmitting a pulling force required to pull the first car 502 after the second car 503, when the second car 503 is moving, and/or suitable for transmitting the pushing force required to push the first car 502 in front of the second car 503, when the second car 503 is moving, the bar 505 having a longitudinal axis, a connection 504 suitable to connect the bar 503 to the first car 502 or the second car 503 and suitable to transmit the pulling force and/or the pushing force from the second car 503 to the bar 505 or from the bar 505 to the first car 502, wherein the bar 505 is slidably coupled with regard to the connection 504, and the bar 505 and the connection 504 comprise each at least one guide element 506, 507, which are arranged such that the guide element 507 of the bar 505 and the guide element 506 of the connection 504 come into contact for alignment (preferably for centering) of the bar 505 with regard to the connection 504, preferably along or parallel to a longitudinal axis of the respective car 502, 503, upon a relative movement of the connection 504 towards the bar 505 (in case of a crash indicated in FIG. 22).

It is provided: An assembly of parts suitable to be used as part of a connecting device 501 for connecting a first car 502 of a multi-car vehicle with a second car 503 of said vehicle, comprising: a bar 505 suitable for transmitting a pulling force required to pull the first car 502 after the second car 503, when the second car 503 is moving, and/or suitable for transmitting the pushing force required to push the first car 502 in front of the second car 503, when the second car 503 is moving, the bar 505 having a longitudinal axis, a connection 504 suitable to connect the bar 505 to the first car 502 or the second car 503 and suitable to transmit the pulling force and/or the pushing force from the second car 503 to the bar 505 or from the bar 505 to the first car 502, wherein the bar 505 and/or the connection 504 comprises at least two engagement sections 508 for the connection 504 and the bar 505, respectively, to align (preferably to center) the bar 505 relative to the connection 504, preferably along or parallel to a longitudinal axis of the respective car 502, 503, upon a relative movement of the connection 504 towards the bar 5.

It is provided: An assembly of parts suitable to be used as part of a connecting device 501 for connecting a first car 502 of a multi-car vehicle with a second car 503 of said vehicle, comprising: a bar 505 suitable for transmitting a pulling force required to pull the first car 502 after the second car 503, when the second car 503 is moving, and/or suitable for transmitting the pushing force required to push the first car 502 in front of the second car 503, when the second car 503 is moving, the bar 505 having a longitudinal axis, a connection 504 suitable to connect the bar 505 to the first car 502 or the second car 503 and suitable to transmit the pulling force and/or the pushing force from the second car 503 to the bar 505 or from the bar 505 to the first car 502, wherein the bar 505 is coupled to the connection 504 by a pivot joint 509, the pivot joint 509 being slidably guided by the connection 504 in a direction along the longitudinal axis of the respective car 502, 503, wherein upon a relative movement of the connection 504 towards the bar 505 the pivot joint 509 moves towards the connection 504 limiting the pivot movement of the bar 505 with regard to the pivot joint 509.

It is provided: An assembly of parts suitable to be used as part of a connecting device 501 for connecting a first car 502 of a multi-car vehicle with a second car 503 of said vehicle, comprising: a bar 505 suitable for transmitting a pulling force required to pull the first car 502 after the second car 503, when the second car 503 is moving, and/or suitable for transmitting the pushing force required to push the first car 502 in front of the second car 503, when the second car 503 is moving, the bar 505 having a longitudinal axis, a connection 504 suitable to connect the bar 505 to the first car 502 or the second car 503 and suitable to transmit the pulling force and/or the pushing force from the second car 503 to the bar 505 or from the bar 505 to the first car 502, wherein the pivot joint 509 is guided with regard to the connection 504 allowing a translatory movement only in one direction with regard to the connection 504.

Preferably, the pivot joint 509 comprises a pivot axis 510 transverse to the longitudinal axis (in the vertical direction) of the bar 505, wherein a ball-shaped outer surface 511 is provided, and the bar 505 comprises a section 512 which is arranged to receive the ball-shaped outer surface 511 for pivoting the pivot axis 510 relative to the bar 505.

Preferably, at least one flange 513 is formed at the pivot axis 510 in a fixed position relative to each other. The flange 513 extends in a longitudinal guiding 514 of the connection 504 for a translatory movement of the pivot axis 510 with regard to the connection 504.

Preferably, the longitudinal guiding comprises a slot in the connection.

Preferably, the flange 513 comprises at least one retaining lug 515 limiting the longitudinal movement of the flange 513 with regard to the longitudinal guiding 514 and/or the connection 504.

Preferably, the at least one flange 513 is guided in the slot 516 in positive fitting.

Preferably, two flanges 513 are provided, arranged spaced apart to each other and separated by the bar 505.

Preferably, the longitudinal guiding 514 provides at least one stop 517, 518 for the translatory movement of the flange 513 relative to the longitudinal guiding 514.

Preferably, the connection 504 comprises guiding surfaces 519 for guiding one end of the bar 505 upon movement of the bar 505 towards the connection 504.

Preferably, the distance between the end of the bar 505 and the at least one guiding element 506 of the bar 505 correlates to the distance between the beginning of the guiding surfaces 519 and the at least one guiding element of the connection 507.

Preferably, the at least one guiding element 507, 508 on the bar 505 and the connection 504 are provided for guiding the bar 505 with regard to the connection 504 in one direction and at least one further guiding element 520, 521 on the bar 505 and the connection 504 are provided for guiding the bar 505 with regard to the connection 504 in a further direction.

Preferably, the direction is in the vertical direction, especially centering in an anti-climb direction, and the further direction, especially centering in an anti-jack direction, is in the longitudinal direction.

Preferably, the at least one guiding element 508 of the connection 504 is formed as at least one inclined surface facing the bar 505.

Preferably, the guiding element 508 of the connection 504 comprises two inclined surfaces spaced apart to each other, facing the bar 505.

Preferably, the inclined surface(s) has/have an angle which limits the pivot movement of the bar 505 by engagement of the inclined surface of the connection 504 with a counter-surface of the bar 505, whereby by relative movement of the bar 505 towards the connection 504 the two inclined surfaces of the connection 504 center the bar by contacting respective counter-surfaces of the bar 505.

Preferably, the at least further guiding element 521 of the connection 504 is a guiding surface for a counter-surface of the bar 505 which are adapted to engage each other in a predetermined position upon relative movement of the connection with regard to the bar 505, i.e. in a stabilized position, shown in FIG. 26.

Preferably, two further guiding elements 520 are provided around the circumference of the bar 505, equally spaced apart from each other, wherein a connection line between the two further guiding elements 520 is parallel to the pivot axis 510.

The invention claimed is:

1. A multi-car vehicle with a first car of the multi-car vehicle and a second car of said vehicle having a connection device including:

an elongated body configured for transmitting a pushing force required to push the first car in front of the second car, when the second car is moving, the elongated body comprising a bar having a longitudinal axis and including an energy dissipating section as part of the bar or arranged on the bar; and a connection to connect the elongated body to the first car or the second car and configured to transmit the pushing force from the second car to the elongated body or from the elongated body to the first car;

wherein the first car and/or the second car includes an underframe that comprises at least one longitudinal beam and/or at least one cross beam, wherein the elongated body is arranged approximately at the same vertical level as the longitudinal beam and/or the cross beam and/or is arranged such that the elongated body at least partially overlaps with the beam in the vertical direction.

2. The multi-car vehicle according to claim 1, wherein the underframe has a central longitudinal beam that is arranged approximately along the longitudinal axis of the first car, wherein the elongated body is arranged approximately at the same vertical level as the central longitudinal beam and/or is arranged such that the elongated body at least partially overlaps with the central longitudinal beam in the vertical direction.

3. The multi-car vehicle according to claim 1, wherein the underframe has a cross beam supported by a bogie, wherein the elongated body is arranged approximately at the same vertical level as the cross beam supported by the bogie and/or is arranged such that the elongated body at least partially overlaps with the cross beam supported by the bogie in the vertical direction.

4. The multi-car vehicle according to claim 1, wherein the underframe has side-beams that run parallel to the longitudinal axis of the first car at the sides of the first car, and wherein the side-beams end before the end of the first car, and wherein a door of the first car is arranged in the section of the first car that has no side-beam.

5. The multi-car vehicle according to claim 1, further comprising:

a first blocking surface or a first locking member arranged on the elongated body on one side of the pivot axis, the first blocking surface or first locking member being held distanced from a corresponding blocking surface or a corresponding locking member respectively arranged on the connecting parts in a first operational state and the first blocking surface or the first locking member being in contact with the corresponding blocking surface or the locking member in a second operational state, when the elongated body has been moved along its longitudinal axis relative to the connecting parts, the contact between the respective blocking surfaces or the contact between the respective locking members blocking a rotation of the elongated body about the pivot axis; and a second blocking surface or a second locking member arranged on the elongated body on the opposite side of the pivot axis relative to the first blocking surface or the first locking member, the second blocking surface or second locking member being held distanced from a corresponding blocking surface or a corresponding locking member respectively arranged on the connecting parts in a first operational state, and the second blocking surface or the second locking member being in contact with the corresponding blocking surface or the locking member in a second operational state, when the elongated body has been moved along its longitudinal axis relative to the connecting parts, the contact between the respective blocking surfaces or the contact between the respective locking members blocking a rotation of the elongated body about the pivot axis, wherein the connection comprises a connecting device for connecting the first car with the second car of said vehicle, and wherein the connection defines a pivot axis about which the elongated body can pivot relative to other parts of the connection, the pivot axis crossing the elongated body and/or the longitudinal axis, and the connection comprises connecting parts suitable to be connected to the first car, whereby the elongated body is elastically connected to the connection parts thereby allowing the elongated body to move relative to the connecting parts in the direction of the longitudinal axis.

6. A multi-car vehicle according to claim 1, wherein the bar has an inclined surface provided at a front end section of the bar and wherein a counter-surface is arranged to come into contact with the inclined surface to prevent the bar to move further in the vertical direction than the interaction between the inclined surface and the counter-surface allows; or the bar has a counter-surface provided at a front end section of the bar and wherein an inclined surface is arranged to come into contact with the counter-surface to prevent the bar to move further in the vertical direction than the interaction between the inclined surface and the counter-surface allows.

7. A multi-car vehicle according to claim 6, wherein the connection comprises a plate that has a hole, through which the bar passes, the hole being sized so that the bar can pass through the hole without touching the sidewalls delimiting the hole, and wherein the connection comprises:

a vertical limitation part that limits the vertical movement of a section of a horizontally extending bar, wherein the vertical limitation part limits the vertical movement of the section of the bar that passes through the hole, when the bar is extending horizontally, and/or the vertical movement of a section of the bar in the proximity of the hole, the vertical limitation part configured to limit the vertical movement only at a place proximate the plate, while allowing vertical movements further away from the plate to allow the bar to swivel about a horizontal axis at or in proximity of the plate with the hole; and/or a lateral limitation part that limits the sideways movement of a section the bar when the bar is extending horizontally, the lateral limitation part limiting the sideways movement of the section of the bar that passes through the hole, when the bar is extending horizontally, and/or the sideways movement of a section of the bar in the proximity of the hole, the lateral limitation part configured to limit the lateral movement only at a place proximate the plate, while allowing lateral movements further away from the plate to allow the bar to swivel about a vertical axis at or in proximity of the plate with the hole; and/or a rotational limitation part that limits rotational movements of a section of the bar; and/or an axial limitation part that limits the axial movement of the bar relative to the plate that has a hole in at least in the forward or the rearward axial direction of the bar.

8. The multi-car vehicle according to claim 7, wherein an axial limitation part and a vertical limitation part are provided and wherein the horizontal axis about which the bar is allowed to swivel changes its position relative to the plate having a hole therein depending on the axial position of the bar and/or an axial limitation part and a lateral limitation part are provided and wherein the vertical axis about which the bar is allowed to swivel changes its position relative to the plate having a hole therein depending on the axial position of the bar.

9. A multi-car vehicle according to claim 1, further comprising a gangway floor for a gangway between the first car of the multi-car vehicle and the second car of said vehicle, wherein the gangway floor comprises a first floor panel and a second floor panel, the first floor panel arranged to rotate about a first axis that does not lie in the plane that the first floor panel lies in, and the second floor panel arranged to rotate about a second axis that does not lie in the plane that the second floor panel lies in, wherein the first axis is different from the second axis, and wherein the first axis coincides with the pivot axis.

10. The multi-car vehicle according to claim 1, further comprising a gangway floor for a gangway between the first car of the multi-car vehicle and the second car of said vehicle, wherein the gangway floor comprises a first floor panel that has the shape of a sector of a circle or the shape of a segment of a circle or the shape of a sector of a ring; and a second floor panel that has the shape of a sector of a circle or the shape of a segment of a circle or the sector of a ring.

* * * * *